US007536146B2

(12) United States Patent
Iwaishi et al.

(10) Patent No.: US 7,536,146 B2
(45) Date of Patent: May 19, 2009

(54) FLASH FIXING DEVICE, IMAGE FORMING DEVICE USING THE SAME, AND FLASH LAMP LIGHT EMISSION CONTROL METHOD

(75) Inventors: Akira Iwaishi, Ebina (JP); Mitsuhiro Mori, Ebina (JP); Ryo Kitao, Ebina (JP); Teruki Kishimoto, Ebina (JP); Hiroshi Nou, Ebina (JP); Kouichi Sanpei, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 183 days.

(21) Appl. No.: 11/488,094

(22) Filed: Jul. 18, 2006

(65) Prior Publication Data

US 2008/0019745 A1 Jan. 24, 2008

(51) Int. Cl.
*G03G 15/20* (2006.01)

(52) U.S. Cl. ..... 399/336; 399/67; 399/337

(58) Field of Classification Search ..... 399/67, 399/334, 336, 337
See application file for complete search history.

(56) References Cited

U.S. PATENT DOCUMENTS 5,436,710 A * 7/1995 Uchiyama ..... 399/336
7,254,363 B2 * 8/2007 Nakamura et al. ..... 399/336

FOREIGN PATENT DOCUMENTS

JP A-2001-142347 5/2001
JP 2006-119567 5/2006

* cited by examiner

*Primary Examiner*—Hoang Ngo
(74) *Attorney, Agent, or Firm*—Morgan, Lewis & Bockius LLP

(57) ABSTRACT

A flash fixing device comprises a first and second flash lamps that emit flashes of light that fix a toner image transferred onto a recording medium and a light emission control unit that controls the light emissions of the first and second flash lamps so that the light flashes emitted from the first flash lamp and the second flash lamp are each irradiated at different timing on each portion on the recording medium.

19 Claims, 25 Drawing Sheets

CONDUCTING TO TRIGGER ELECTRODES OF FLASH LAMP GROUPS A AND B

FIRST LIGHT EMISSION OF FLASH LAMP GROUP A

SECOND LIGHT EMISSION OF FLASH LAMP GROUP A

FIRST LIGHT EMISSION OF FLASH LAMP GROUP B

SECOND LIGHT EMISSION OF FLASH LAMP GROUP B

CONDUCTING TO TRIGGER ELECTRODE OF FLASH LAMP GROUP A

FIRST LIGHT EMISSION OF FLASH LAMP GROUP A

SECOND LIGHT EMISSION OF FLASH LAMP GROUP A

CONDUCTING TO TRIGGER ELECTRODE OF FLASH LAMP GROUP B

FIRST LIGHT EMISSION OF FLASH LAMP GROUP B

SECOND LIGHT EMISSION OF FLASH LAMP GROUP B

| | ORDER OF LIGHT EMISSION | ENERGY DENSITY ON RECORDING MEDIUM | | |
|---|---|---|---|---|
| | | A | B | C |
| COMPARATIVE EXAMPLE | LIGHT EMISSION PATTERN 1 | SIMULTANEOUS LIGHT EMISSION | | |
| | LIGHT EMISSION PATTERN 2 | 49A 49C<br>49B → 49D<br>(STUDY TWICE ONLY) (STUDY TWICE ONLY) | | |
| | LIGHT EMISSION PATTERN 3 | 49A→49B<br>→49C→49D | | |

| | | ORDER OF LIGHT EMISSION | TEMP. VALIATION OF TONER LAYER | | |
|---|---|---|---|---|---|
| | | | A | B | C |
| COMPARATIVE EXAMPLE | LIGHT EMISSION PATTERN 1 | SIMULTANEOUS LIGHT EMISSION |  |  |  |
| | LIGHT EMISSION PATTERN 2 | 49A 49C<br>49B → 49D<br>(SIMULTANEOUSLY) (SIMULTANEOUSLY) |  |  |  |
| | LIGHT EMISSION PATTERN 3 | 49A→49B<br>→49C→49D |  |  |  |

FLASH FIXING DEVICE, IMAGE FORMING DEVICE USING THE SAME, AND FLASH LAMP LIGHT EMISSION CONTROL METHOD

BACKGROUND OF THE INVENTION

1. Technical Field

The present invention relates to a flash fixing device that fixes a toner image transferred onto a recording medium with light flashes irradiated from flash lamps, to an image forming device that uses this flash fixing device, and to a method for controlling light emissions from flash lamps.

2. Related Art

In an image forming device that forms images using an electrophotographic system, toner images formed from powdered toner are transferred onto a recording medium. After that, heat energy is applied to the recording medium to which the toner image was transferred (i.e., to the powdered toner on the recording medium), and the toner image is fixed on the recording medium by fusing the powdered toner. The heat energy for fixing the toner image is often supplied using heat rollers, however, flash fixing systems are used in high-performance image forming devices that can form mass amounts of images at high speed (e.g., in image forming devices that can form images on 500 sheets of recording medium equivalent to A4 per second). In a flash fixing system, powdered toner is fused by intermittently illuminating flash lamps and irradiating the light emitted from the flash lamps, whereby energy that fixes the toner image is supplied. Flash fixing systems are well-suited to high-speed image formation because high energy can be supplied without contact with the recording medium, hence, conveying of the recording medium is not adversely affected.

High-performance image forming devices have for the most part been applied to monochromatic ledger sheet printing. Nonetheless, even in ledger sheet printing, there are cases where the user wishes to print in color, for example, when adding a corporate logo to the header or footer of the ledger sheet. There is an ever-increasing need to improve upon color printing for high-performance image forming devices. Formation of color images with electrophotographic systems is performed by overlaying toner images of each color C (cyan), M (magenta), Y (yellow) (and K (black)). With this, the amount of toner transferred to the recording medium increases (i.e., the amount of toner to be fixed), whereby it becomes necessary to supply greater energy in order to fix the toner image.

In flash fixing systems, increases in the supplied energy can be achieved by lowering the speed by which the recording medium is conveyed (e.g., if the conveying speed is reduced by one half, twice as much energy is supplied) or by shortening the light emission cycles of the flash lamps (e.g., if the light emission cycle is made one half (i.e., the light emission frequency number is doubled) then twice as much energy is supplied). However, decreasing the conveying speed of the recording medium is not preferable because this results in the processing capability decline of the image forming device. Also, shortening the light emission cycles of the flash lamps is problematic in that the life of the flash lamps shortens and rises in the lamp temperature also increase. Further, if the number of flash lamps is increased, the supplied energy can be increased without reducing the conveying speed or shortening the light emission cycle. However, if a large amount of energy is supplied all at once, the toner composition sublimates (i.e., water included in the toner), whereby there might be cases where image deterioration such as dot patches (i.e., white points) occurs.

SUMMARY

A flash fixing device according to one exemplified example of the present invention includes: first and second flash lamps that emit light flashes that fix a toner image transferred onto a recording medium; and a light emission control unit that controls the light emission of the first and second flash lamps so that the light flashes emitted from the first flash lamp and the light flashes emitted from the second flash lamp are each irradiated at a different timing on respective portions of the recording medium onto which the toner image is transferred.

BRIEF DESCRIPTION OF THE DRAWINGS

Embodiments of the present invention will be described in detail based on the following drawings, wherein.

DETAILED DESCRIPTION

Figure 1:
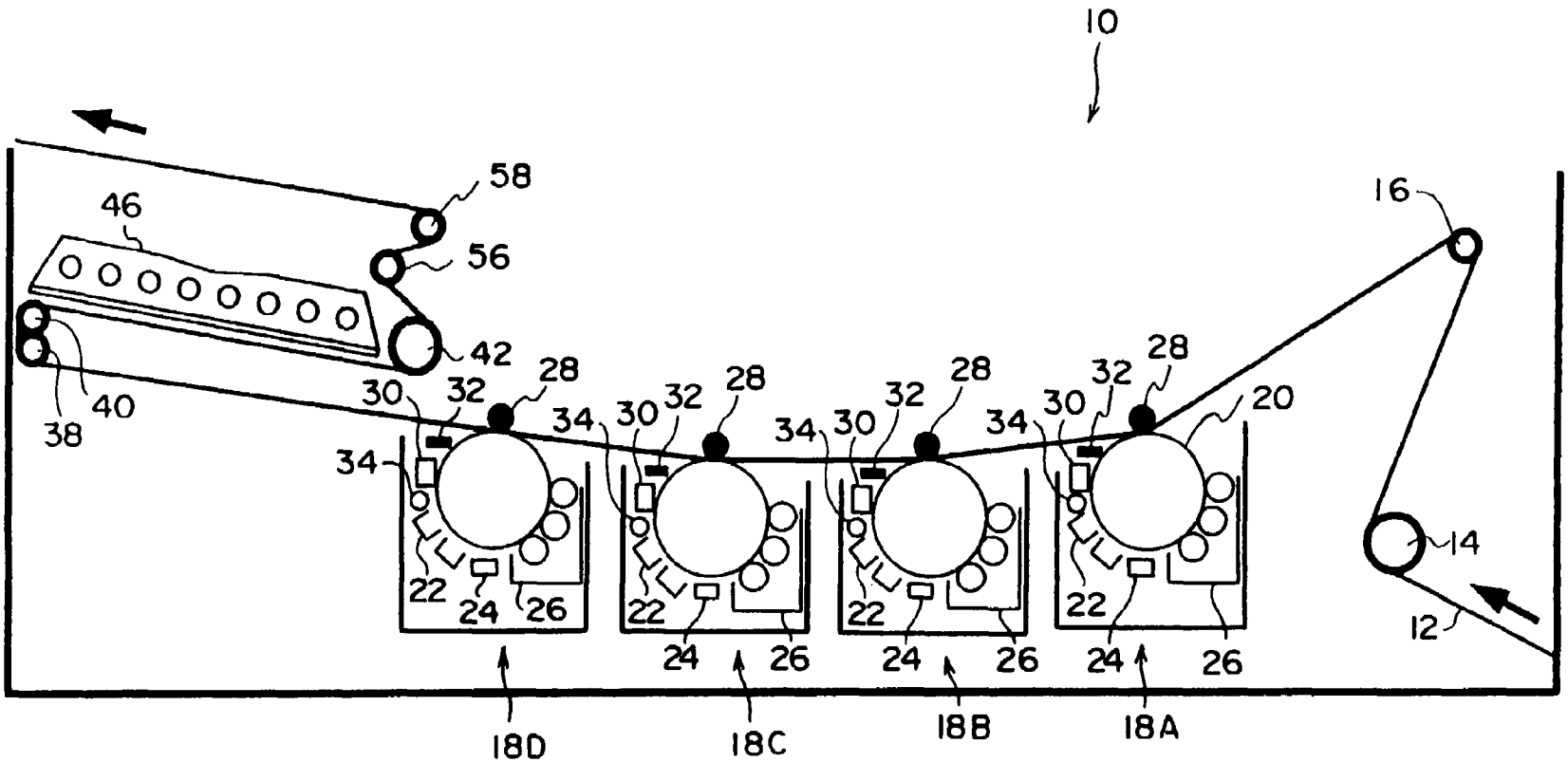
FIG. 1 is an outline structure drawing of an image forming device according to the present invention.

With the present embodiments designed as described hereinafter, the light emissions of the flash lamps are controlled so that the light from the flash light are irradiated at different timing on each portion on the recording medium where the toner image to be fixed has been transferred.

Hereafter, examples of embodiments of the present invention will be explained in detail while referring to the drawings.

First Embodiment

A color image forming device 10 according to the present embodiment is shown in FIG. 1. The color image forming device 10 forms a color image on a recording medium 12 made from successive sheets of paper in which perforated lines for cutting have been provided in advance. The recording medium 12 inserted into the machine of the color image forming device 10 is wound around wind-up rollers 14, 16. The recording medium 12 is conveyed at a constant speed on a conveying route formed inside the machine so as to be cut across. Image forming units 18A, 18B, 18C and 18D that form toner images of each color C (cyan), M (magenta), Y (yellow) and K (black) are arranged at approximately equal intervals at the downward side of the conveying route of the recording medium 12 along said route.

With the exception of the colors of the toner images they form, each of the image forming units 18A-18D have the same configuration. Each of the image forming units 18A-18D are provided with a photosensitive drum 20 arranged such that their axial lines are perpendicular to the conveying direction of the recording medium 12. The following components include the periphery of each of the photosensitive drums 20: A charger 22 for charging the photosensitive drum 20; a light beam scanning device 24 that irradiates laser beams on the charged photosensitive drum 20 and forms an electrostatic latent image; a developer 26 that supplies toner of a preset color to the region on the photosensitive drum 20 on which the electrostatic latent image was formed and forms a toner image of the preset color on the photosensitive drum 20 by developing the electrostatic latent image; a copier 28 that is arranged opposite the photosensitive drum 20 with sandwiching the conveying route of the recording medium 12 therebetween; a neutralizer 30 that neutralizes the photosensitive drum 20; and a cleaner blade 32 and cleaner brush 34 for removing residual toner from the photosensitive drum 20.

After the image forming units 18A-18D form toner images of color differing from each other on the peripheral surface of the photosensitive drum 20 with the charger 22, light beam scanning device 24, and developer 26, the formed toner images are transferred to the recording medium 12 with the copier 28. The entire succession of charging, exposing (i.e., forming the electrostatic latent image), developing (i.e., forming the toner image), and transferring processes in each of the image forming units 18A-18D are controlled so as to be executed at special timing, namely, so that the toner images formed with each of the image forming units 18A-18D overlap each other on the recording medium 12. With this configuration, full-color toner images are formed on the recording medium 12.

Also, the direction of conveyance on the conveying route of the recording medium 12 is counterturned with wind-up rollers 38, 40 at the downstream side of the areas where the image forming units 18A-18D are arranged, and then, between the interval of the wind-up roller 40 and a wind-up roller 42 at a latter stage, the recording medium 12 is conveyed downward at an angle that is close to horizontal. A flash fixing unit 46 is set above the conveying route located at the interval between the wind-up rollers 40, 42.

Figure 2A:
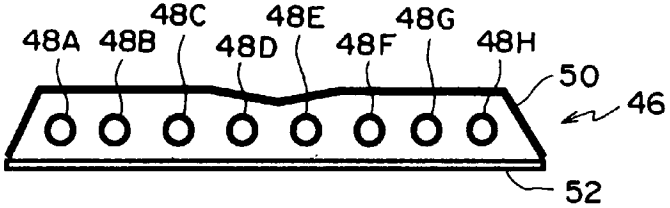
FIG. 2A is an outline drawing of a flash fixing unit according to the first embodiment.

As shown in FIG. 2A, the flash fixing unit 46 is provided with eight flash lamps 48A-48H, each of which emits light flashes for providing energy that fixes the toner images (i.e., fuses the toner) transferred to the recording medium 12. Each of the flash lamps are faced so that their longitudinal directions follow along the widthwise direction of the recording medium 12 (i.e., in the direction perpendicular to the conveying direction of the recording medium 12) and these are arranged at constant intervals along the conveying direction of the recording medium 12. Also, when viewing the device from the conveying route side of the recording medium 12, a reflecting board 50 is provided at the rear face side of the flash lamps 48. The reflecting board 50 is shaped to enclose the rear face sides of the eight flash lamps 48 and openings are formed in the frontal face side (i.e., at the conveying route side). The light flashes emitted from the flash lamps 48 to the rear surface side are reflected to the conveying route side with the reflecting board 50.

With the present embodiment, flash lamps 48A, 48C, 48E and 48G of the eight flash lamps 48A-48H are arranged as one group along the direction of conveyance of the recording medium 12, while flash lamps 48B, 48D, 48F and 48H are similarly arranged as one group. (Hereafter, flash lamps 48A, 48C, 48E and 48G are referred to as the "first flash lamp group" and flash lamps 48B, 48D, 48F and 48H are referred to as the "second flash lamp group".) The flash lamps in each of the groups are made to light (to be described in detail later). Aspects of the reflecting board 50 such as the shape and the like are adjusted so that the light from the flashes irradiated on the recording medium 12 attains a substantially equal luminosity (i.e., equal energy) across almost the entire range of the surface of irradiation. This is designed to be so when each of the flash lamps 48 of both the first and second flash lamp groups is illuminated.

A cover glass 52 is also arranged at the frontal face side of the flash lamps 48 (i.e., at the conveying route side). The cover glass 52 is provided so as to close the openings of the reflecting board 50, and the entry of dust and the like into the interior of the flash fixing unit 46 is thus blocked by this cover glass 52.

Figure 3:
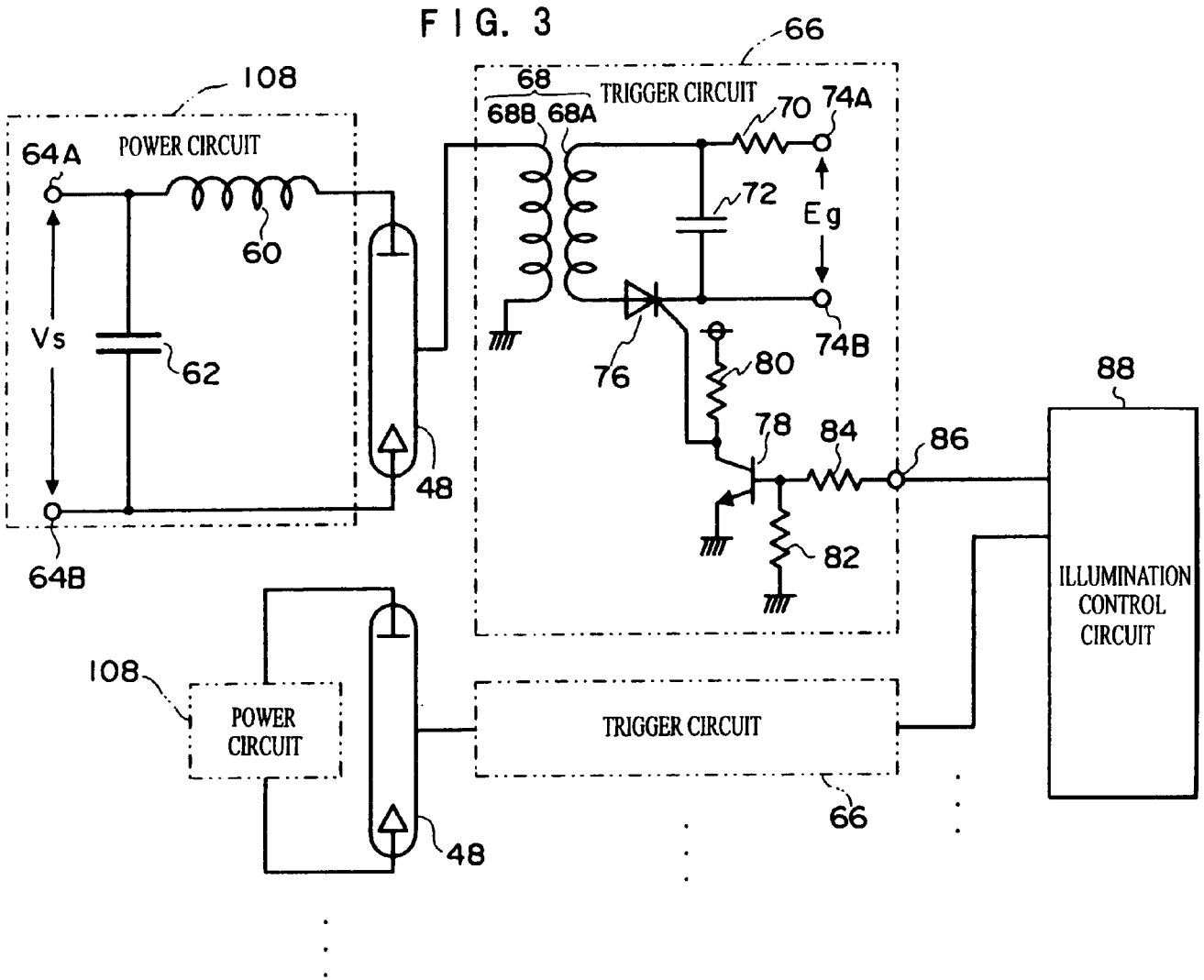
FIG. 3 is an outline structure drawing of a flash lamp drive system.

As shown in FIG. 3, both ends of each individual flash lamp of the flash fixing unit 46 are connected to a power circuit 108. That is, one end of the flash lamp 48 is connected to a power terminal 64B and the other end of the flash lamp 48 is connected to one end of a choke coil 60. The other end of the choke coil 60 is connected to each of one end of a power terminal 64A and a condenser 62. The other end of the condenser 62 is connected to the power terminal 64B. Direct current voltage Vs generated by, for example, commercial alternating voltage being rectified and surged is supplied to the power terminals 64A, 64B. The condenser 62 is charged by the direct current voltage Vs and the accumulated static electric energy is supplied to the flash lamp 48 when the flash lamp 48 emits light.

The trigger electrode of the flash lamp 48 is connected to a trigger circuit 66. The trigger circuit 66 is provided with a trans 68, and one end of the trigger electrode of the flash lamp 48 is connected to the other end of a secondary side coil 68B of the grounded trans 68. Further, one end of the primary side coil 68A of the trans 68 is connected to one end of a resist 70 and one end of a condenser 72, and the other end of the resist 70 is connected to a power terminal 74A. The other end of the primary side coil 68A is connected to one end of a thyristor 76, and the other end of the thyristor 76 is connected to the other end of the condenser 72 and to a power terminal 74B. The condenser 72 is charged with the direct current voltage Eg supplied via the power terminals 74A, 74B. When the thyristor 76 enters a state of conduction, the accumulated static electric energy is supplied to the trigger electrode of the flash lamp 48 via the trans 68, whereby the flash lamp 48 emits light.

Further, the gate of the thyristor 76 is connected to the collector of a transistor 78. The collector of the transistor 78 is connected to a power feed line through a resist 80 and the emitter is grounded. One end of the base of the transistor 78 is also connected to the other end of a grounded resist 82 while also being connected to a control signal input terminal 86 via a resist 84. Then the control signal input terminal 86 is connected to an illumination control circuit 88 configured to include components such as a microcomputer. The illumination control circuit 88 supplies a control signal to the trigger circuit 66 via the control signal input terminal 86. This control signal switches between high level during the period where the flash lamp 48 is extinguished and low level when the flash lamp 48 is illuminated. While the control signal is at the low level, the transistor 78 turns off whereby the thyristor 76 conducts and the static electric energy accumulated in the condenser 72 is supplied to the trigger electrode of the flash lamp 48 via the trans 68, whereby the flash lamp 48 is made to emit light.

It should be noted that the above-described power circuit 108 and trigger circuit 66 are each connected to the eight flash lamps 48 of the flash fixing unit 46. The trigger circuits 66 connected to each individual flash lamp 48 are each connected to the illumination control circuit 88, which controls the lighting and extinguishing of each of the eight flash lamps 48.

The wind-up rollers 56, 58 are arranged in this order downstream in the conveying direction of the recording medium 12 of the wind-up roller 42. The recording medium 12, on which the toner image is fixed, is guided by the wind-up rollers 56, 58 and then ejected to the outside of the color image forming device 10. It should be noted that the color image forming device 10 according to the present embodiment is configured to record a color image on only one side of the recording medium 12. Nonetheless, two color image forming devices 10 according to the present embodiment can be prepared while providing a reversing device that reverses the front and back of the recording medium 12, thus making the recording of color images on both sides of the recording medium 12 possible. In this case, the device can be configured to have a second color image forming device 10 and a reversing device arranged such that the recording medium 12 on which a color image has been recorded with the first color image forming device 10 on one side only and then ejected is sent to the inside of the second color image forming device 10 after having been reversed front to back by the reversing device.

Figure 2B:
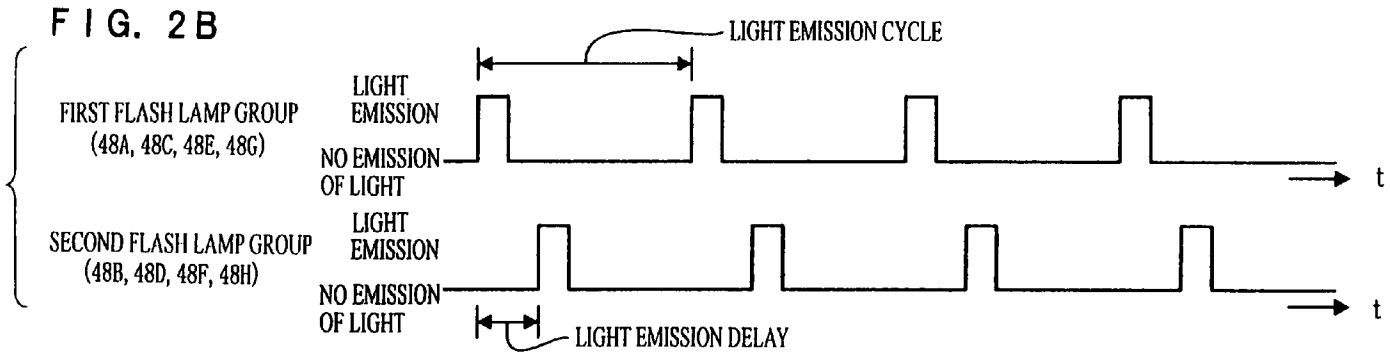
FIG. 2B is a timing chart showing the light emission timing of a first flash lamp group and a second flash lamp group.

The operation of the first embodiment will be explained. When recording of an image to the recording medium 12 with the color image forming device 10 is initiated, the illumination control circuit 88 outputs control signals to the trigger circuit 66 connected to each of the flash lamps 48. An example of this operation is shown in FIG. 2B. The first flash lamp group emits light at a preset illumination cycle and for a preset period while the second flash lamp group emits light at a preset illumination cycle for a preset period and with timing delayed only by the light emission delay shown in FIG. 2B. The light emission delay is relative to the light emission timing of the first flash lamp group.

It should also be noted that in the first embodiment, in a case when light is emitted at a single cycle, the light emission cycle of the flash lamp groups corresponds to a time that is a little less than the period needed for the recording medium 12 to be conveyed half the distance of the length of the recording medium 12 along the conveying direction in the irradiation range of the light flashes on the recording medium 12. Further, the light emission delay between respective flash lamp groups' emission is set to be less than half the light emission cycle. More specifically light emission of the second flash lamp group can be set to start, after the first flash lamp group initiates irradiation, within a period between the irradiated luminosity of the light by the first flash lamp group on portions of the recording medium 12 reaching its peak and returning to zero.

Figure 2C:
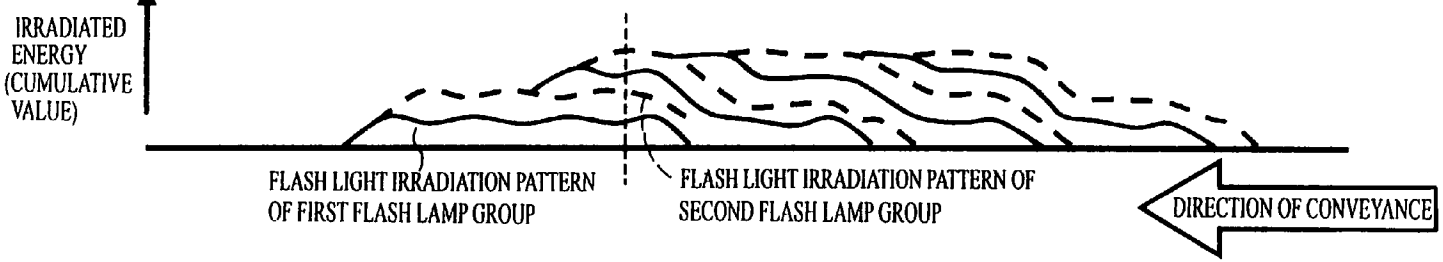
FIG. 2C is a conceptual drawing showing the distribution of the cumulative value of the energy supplied to the recording medium.
Figure 4:
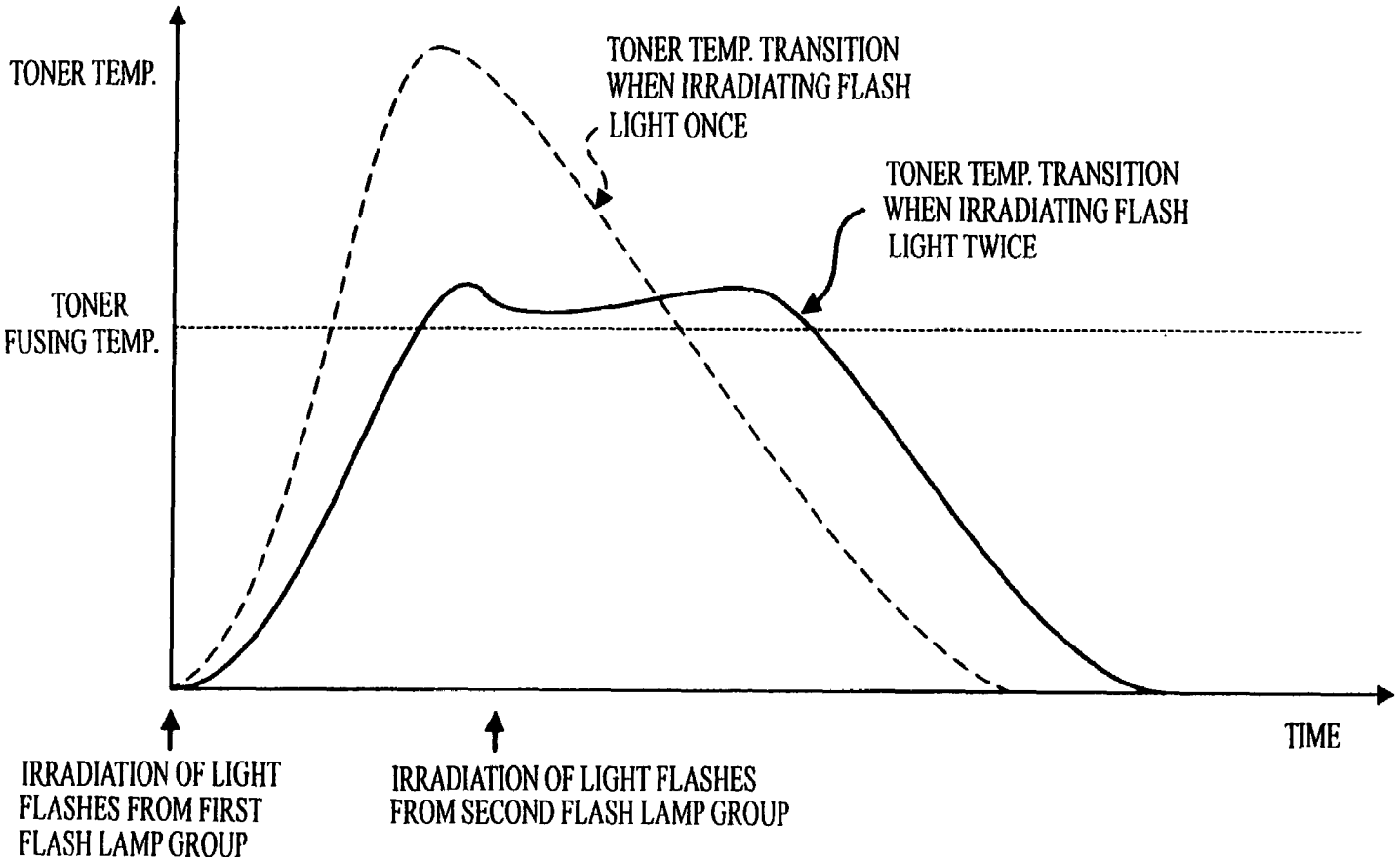
FIG. 4 is a diagram showing an example of temperature change of toner irradiated with flashes of light.

By setting the light emission cycle as described above, a light flash is irradiated four times on each portion on the recording medium 12, as shown in FIG. 2C. Further, by setting the light emission delay as described above, as shown in the example in FIG. 4, the first flash lamp group emits light and the temperature rises to reach a temperature where the toner on the recording medium 12 fuses due to the energy supplied by the light flash. Accordingly, the toner begins to fuse. After that, when the temperature begins to decline due to the emission of light from the first flash lamp group finishing, the second flash lamp group emits light to irradiate the light flash and supply energy, whereby a temperature slightly exceeding the temperature at which the toner fuses is maintained for a relatively long time. By properly setting the light emission delay in this manner, the temperature decline of the toner from the raised temperature that is caused by the first flash lamp group prior to the second flash group beginning to irradiate the flash light can be suppressed. The energy supplied due to the flash light irradiation can be effectively used for fixation of the toner image.

The toner image on the recording medium 12 is a color toner image in which toner images of each of the colors C, M, Y and K are overlapped on each other, so when compared to a toner image of a single color, more energy is necessary in order to fuse the entire amount of toner because much color toner is used to form the color image. By providing a certain time delay in respective light emissions and making the first flash lamp group and second flash lamp group emit light consecutively as described above, the temperature of the toner is maintained at a temperature slightly exceeding the toner fusing temperature for a comparatively long period. For this reason, the toner image on the recording medium 12 (i.e., the color toner image) can be fixed with certainty. Further, even when compared to the toner temperature transition in a case where the toner is fused by irradiating the light from the flashes one time only (see the dotted line in FIG. 4), it is clear that excessive increases in toner temperature can be contained (i.e., that increases in the temperature that greatly exceed the toner fusing temperature can be prevented). Accordingly, the toner image transferred to the recording medium 12 can be fixed without the image quality deterioration such as missing dots (i.e., white spots) occurring in the toner image.

Further, the discharge current flowing to the flash lamps 48 during the light emission thereof becomes almost entirely even without the need such as power feeding, and the above-described image quality deterioration can be prevented, so it is not necessary to set the condenser 62 to have excessively large static electric capacity. Accordingly, the flash fixing device can be designed with a simple configuration and at a low cost.

Furthermore, with the present embodiment, four of eight flash lamps 48 are arranged alternately in the first flash lamp group along the conveying direction of the recording medium 12 and are made to simultaneously emit light. The second flash lamp group is similarly arranged and emits light. For this reason, light from the flashes can be irradiated on the recording medium 12 at an even wider range due to one light emission from the first flash lamp group and the second flash lamp group, respectively. This enables prolonging a light flash cycle and lowering a light emission frequency of flash lamps 48. Due to this, flash lamps 48 having longer life can be achieved.

Second Embodiment

The second embodiment of the present invention will be explained. It should be noted that portions in this embodiment that are the same as in the first embodiment have been assigned the same numeric references, and explanations thereon have been omitted.

Figure 5A:
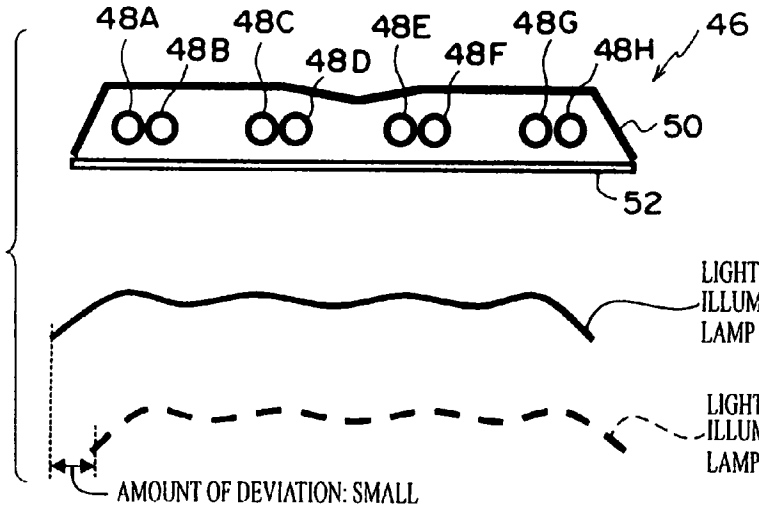
FIG. 5A is an outline drawing of a flash fixing unit according to a second embodiment and an image drawing showing an orientation pattern.
Figure 5B:
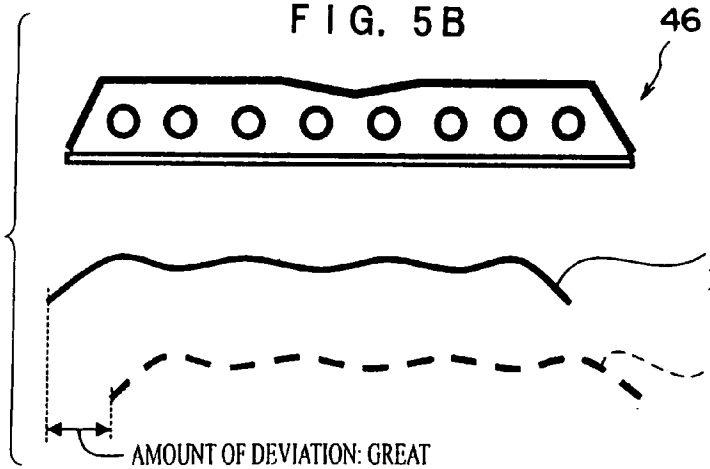
FIG. 5B is an outline drawing of a flash fixing unit according to the first embodiment and an image drawing showing an orientation pattern.

As shown in FIG. 5A, the flash fixing unit 46 according to the second embodiment has eight flash lamps 48 arranged therein. There are portions where adjacent flash lamps 48 are separated at first intervals and portions separated at second intervals shorter than the first intervals. The eight flash lamps 48 are arranged in a manner that the first intervals and the second intervals are set alternately along the direction in which the recording medium 12 is conveyed. Due to this, it is clear by comparing FIGS. 5A and 5B that, along the direction in which the recording medium 12 is being conveyed, the amount of difference in the range of irradiation (i.e., the light distribution pattern) of the flash light made by the first flash lamp group emission and the second flash lamp group emission becomes less than the flash fixing unit 46 explained in the first embodiment.

Figure 5C:
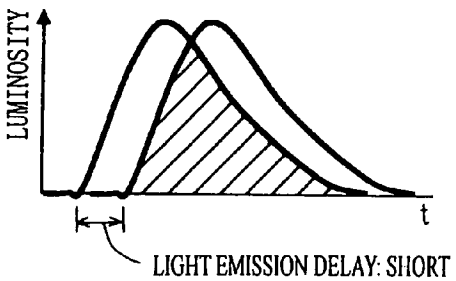
FIG. 5C is a line drawing showing the change patterns of the irradiated luminosity in the flash fixing unit according to the second embodiment.
Figure 5D:
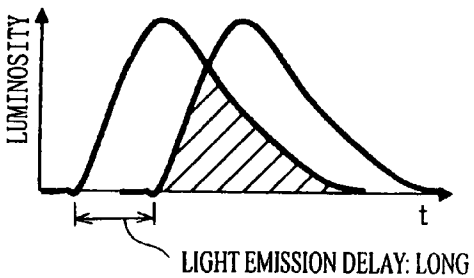
FIG. 5D is a line drawing showing the change patterns of the irradiated luminosity in the flash fixing unit according to the first embodiment.

In a case where, as described above, the difference amount is small in the range of irradiation of the flash light between the first flash lamp group emission and the second flash lamp group emission, the light emission delay for irradiating light at substantially the same range on the recording medium 12 by the first flash lamp group and the second flash lamp group can be set to be even smaller when comparing FIGS. 5C and 5D. Due to this, in substantially the same range on the recording medium 12, toner temperature decline from the raised toner temperature can be further suppressed prior to the irradiation of the flash light by the second flash lamp group. The energy supplied due to the irradiation from the flash light can be used effectively in the fixation of the toner image (i.e., to fuse the toner).

Third Embodiment

The third embodiment of the present invention will be explained. Portions that are the same as in the first and second embodiments have been assigned the same numeric references, and explanations thereon have been omitted.

Figure 6A:
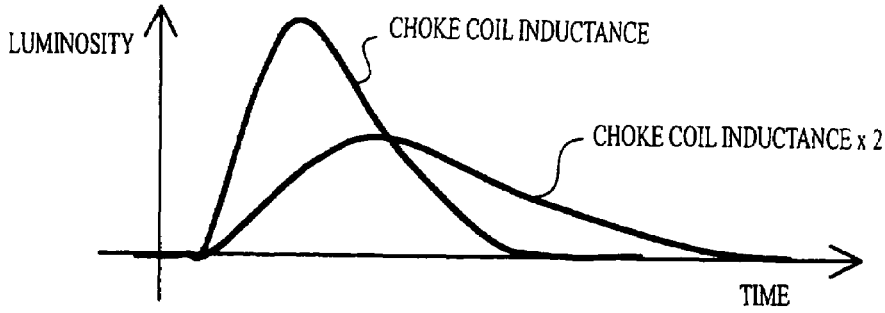
FIG. 6A is a diagram showing the relation between the inductance of the choke coil and the change pattern of the irradiation luminosity of a single lamp.

When the inductance of the choke coil 60 of the power circuit 108 is increased twofold, inclinations in luminosity change and peaks in luminosity of the light flash from the flash lamps 48 can be lessened, as shown in FIG. 6A. Meanwhile, the period during which the flash light of the flash lamps 48 is outputted can be extended. This is due to the electric current flowing to the flash lamps 48 being suppressed. The third embodiment utilizes the above-described phenomenon. The inductance of the choke coil 60 of the power circuit 108 connected to each flash lamp 48 belonging to the second flash lamp group is made larger (e.g., twice as large) as the inductance of the choke coil 60 of the power circuit 108 of the first flash lamp group.

Figure 6B:
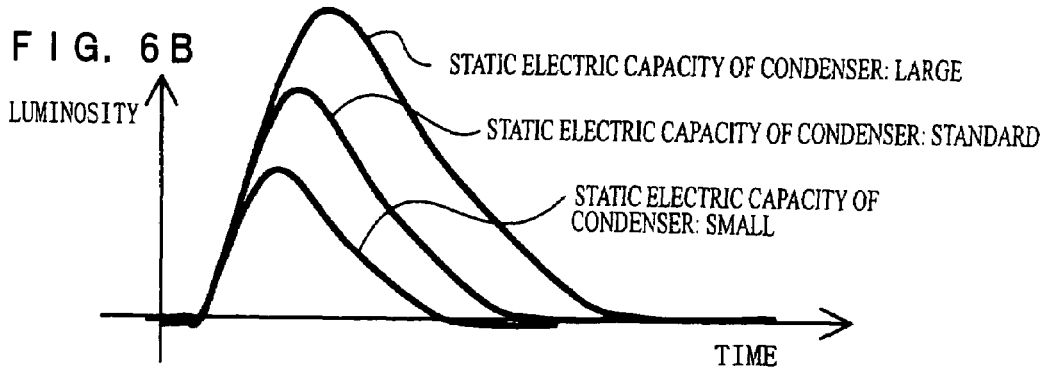
FIG. 6B is a diagram showing the relation between the static electric capacity of the condenser and the change pattern of the irradiation luminosity of a lamp.
Figure 6C:
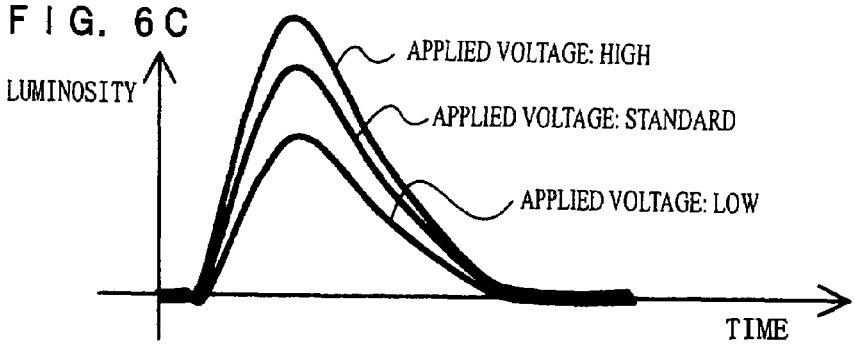
FIG. 6C is a diagram showing the relations between the applied voltage and the change pattern of the irradiation luminosity of a lamp.
Figure 6D:
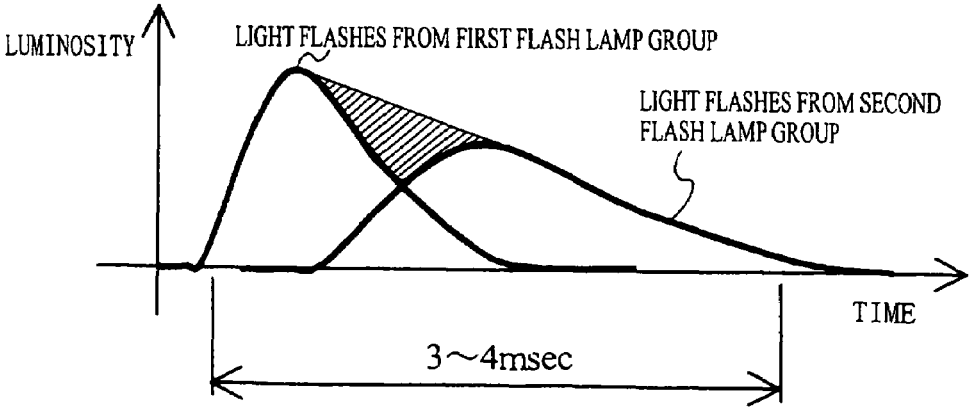
FIG. 6D is a diagram showing the change pattern of the irradiation luminosity in a third embodiment.

Due to this, as shown in the example in FIG. 6D, the flash light of the first flash lamp group is irradiated on the recording medium 12 at comparatively strong peak luminosity and for a comparatively short irradiation period. After the temperature of the toner rises (with the irradiation of this light from the flashes) to a temperature that slightly exceeds the temperature at which the toner fuses, the flash light of the second flash lamp group is irradiated on the recording medium 12 at a comparatively weak peak luminosity and for a comparatively long irradiation period. Due to the irradiation in this manner, the toner is maintained at a temperature that slightly exceeds the fusing temperature for a comparatively long period. By varying the inductances of the choke coil 60, the peaks and variation patterns of the energy added to the toner are made different at the light emissions between the first flash lamp group and the second flash lamp group. The energy supplied due to the irradiation of the flash light can be effectively used upon the fixation of the toner image (i.e., fusing of the toner).

It should be noted that when the static electric capacity of the condenser 62 of the power circuit 108 is made to change, the amount of static electric energy supplied from the condenser 62 to the flash lamps 48 is changed. As shown in FIG. 6B, the luminosity peak of the light flash of the flash lamps 48 increases with the increase in static electric capacity, and the period during which the light flash is outputted from the flash lamps 48 lengthens. Further, when the direct current voltage Vs supplied to the power circuit 108 (i.e., the voltage supplied to the flash lamps 48) via the power terminals 64A, 64B is made to change, the luminosity peak of the light flash of the flash lamps 48 increases as the direct current voltage Vs is increased, as shown in FIG. 6C.

Even when the static electric capacity and direct current voltage Vs of the condenser 62 are changed in this manner, the peaks and variation changes of the luminosity of the light flash which is caused by irradiation of the flash lamps' emission can be diversified. By changing at least any one of the static electric capacity and direct current voltage Vs of the condenser 62 or varying plural physical values selected from the inductances of the choke coil 60, the static electric capacity and direct current voltage Vs of the condenser 62, the peaks and variation patterns of the energy applied to the toner by the first flash lamp group and the second flash lamp group can be changed each other. More specifically, with regard to the flash lamp group that is made to emit light first, the peaks and variation patterns of the luminosities of the light flashes can be adjusted so that the temperature of the toner rises sharply to a value that slightly exceeds the temperature at which the toner fuses. With regard to the flash lamp group that is made to emit light latter, the peaks and variation patterns of the luminosities of the light flashes can be adjusted so that the temperature of the toner is maintained at a value that slightly exceeds the temperature at which the toner fuses for a comparatively long period.

Fourth Embodiment

The fourth embodiment of the present invention will be explained. Portions that are the same as in the first through third embodiments have been assigned the same numeric references, and explanations thereon have been omitted.

In the fourth embodiment, multiple condensers are provided and the electric current is supplied to the flash lamps with multiple systems of condensers. Accordingly, multiple emissions in each light emission cycle of the flash lamps are made possible with this embodiment.

Figure 7:
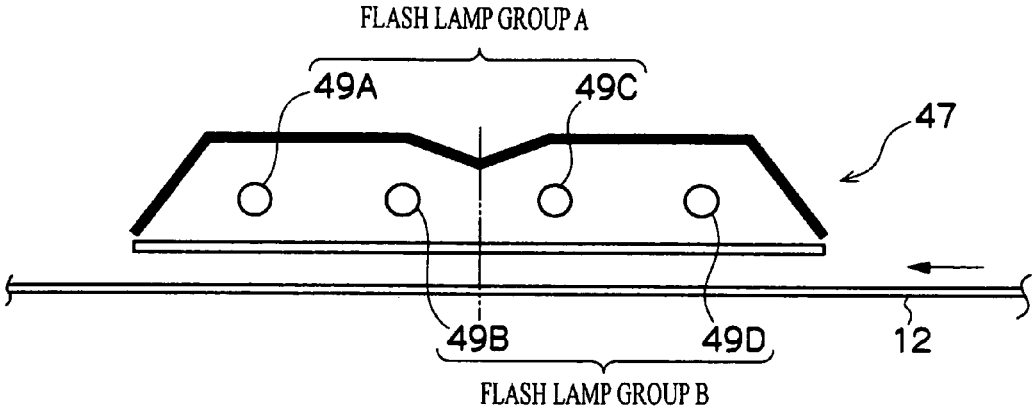
FIG. 7 is an outline structure drawing of a flash fixing unit according to a fourth embodiment.

The flash fixing unit 47 used in the fourth embodiment is provided with four flash lamps 49A-49D, as shown in FIG. 7. Each of the flash lamps 49 are faced so that their longitudinal directions follow along the widthwise direction of the recording medium 12 (i.e., in the direction that is perpendicular to the direction in which the recording medium 12 is conveyed). The flash lamps 49 are arranged at constant intervals along the direction in which the recording medium 12 is conveyed.

With the fourth embodiment, the flash lamps 49A, 49C of the four flash lamps 49A-49D are arranged as one group ("flash lamp group A", the same in the present embodiment) along the direction of conveyance of the recording medium 12, while the flash lamps 49B, 49D are similarly arranged as one group ("flash lamp group B", the same in the present embodiment). The flash lamps 49 in each group are made to illuminate.

Figure 8:
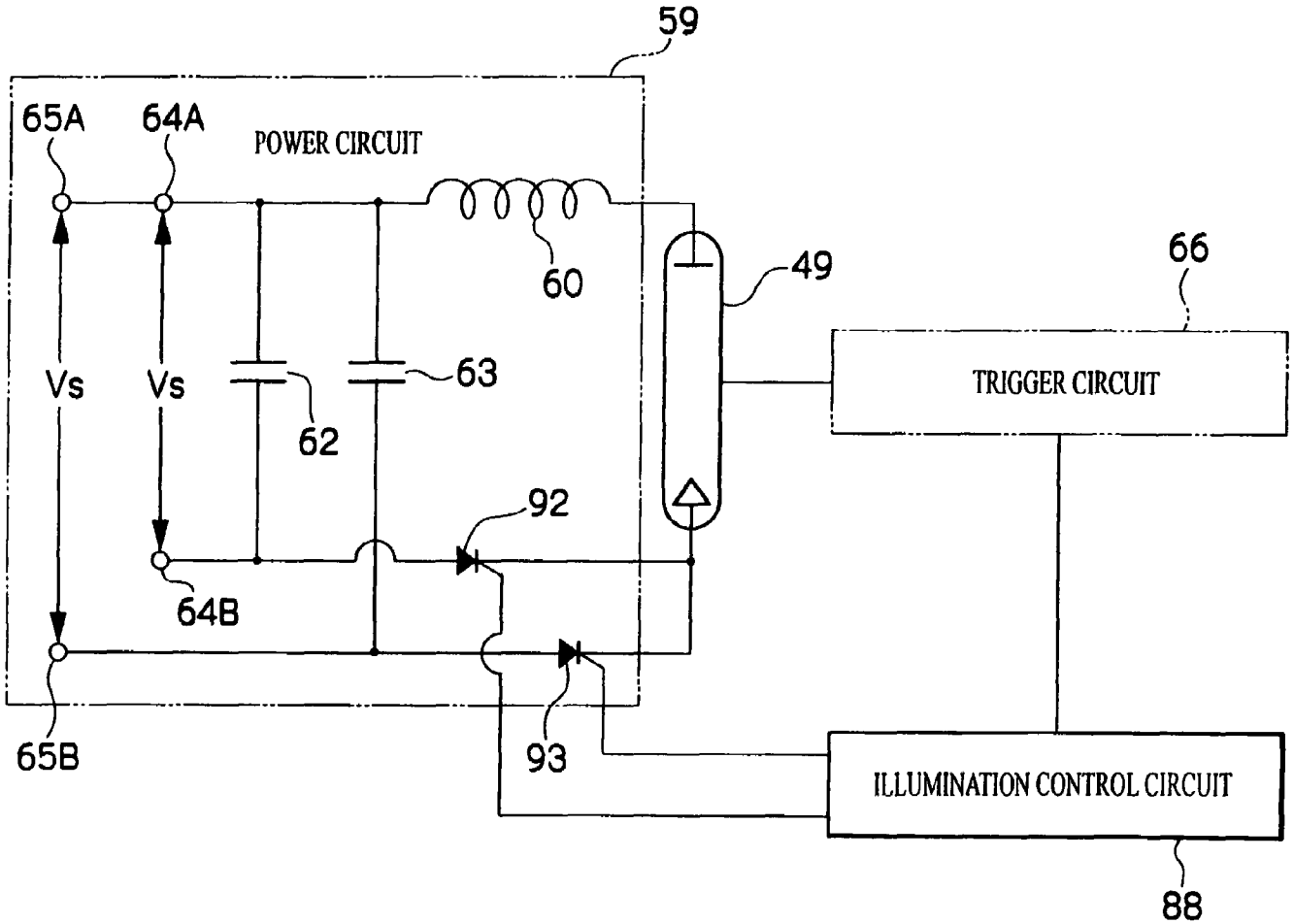
FIG. 8 is an outline structure drawing of a flash lamp drive system according to the fourth embodiment.

A drive circuit, with two condensers connected in a row, that acts as the drive system that lights the flash lamps 49 is shown in FIG. 8. A power circuit similar to the power circuit 108 shown in FIG. 3 and the same trigger circuit 66 are connected to the trigger electrodes of each individual flash lamp 49, both ends of which are connected to a power circuit 59. In addition to the power circuit 108 shown in FIG. 3, in the power circuit 59, one end of a condenser 63 is further connected to one end of the flash lamp 49 and to a power terminal 65B. The other end of the flash lamp 49 is connected to the other end of the condenser 63 and a power terminal 65A via the choke coil 60.

Further, a thyristor 92 is connected between one end of the condenser 62 and one end of the flash lamp 49, and a thyristor 93 is connected between one end of the condenser 63 and one end of the flash lamp 49.

These thyristors 92, 93 are managed by the illumination control circuit 88, and when the thyristors 92, 93 are placed in a state of conductivity with the illumination control circuit 88, the electric current charged by the condensers 62, 63 can be supplied to the flash lamps 49.

That is, electric current is supplied from the trigger circuit 66 to the trigger electrode of the flash lamp 49. Furthermore, when the thyristors 92, 93 are placed in a state of conductivity, electric current is supplied from the condensers 62, 63 to the flash lamp 49 such that the flash lamp 49 emits light.

Since two condensers are provided in this manner, electric current can be supplied from two systems within each light emission cycle of each flash lamp 49 and thus, it becomes possible to emit light two times in one emission cycle.

It should be noted that two condensers are provided according to the fourth embodiment however, these are not limited to two condensers only. Three or more condensers can be connected and in response to this addition, three or more thyristors can be connected. In this case, light emission can be made three or more times within each light emission cycle of respective flash lamps 49.

An example of the light emission timing of the flash lamps 49 will be explained based on the drawings in FIGS. 9A-10F.

Figures 9A, 9B, 9C, 9D, 9E:
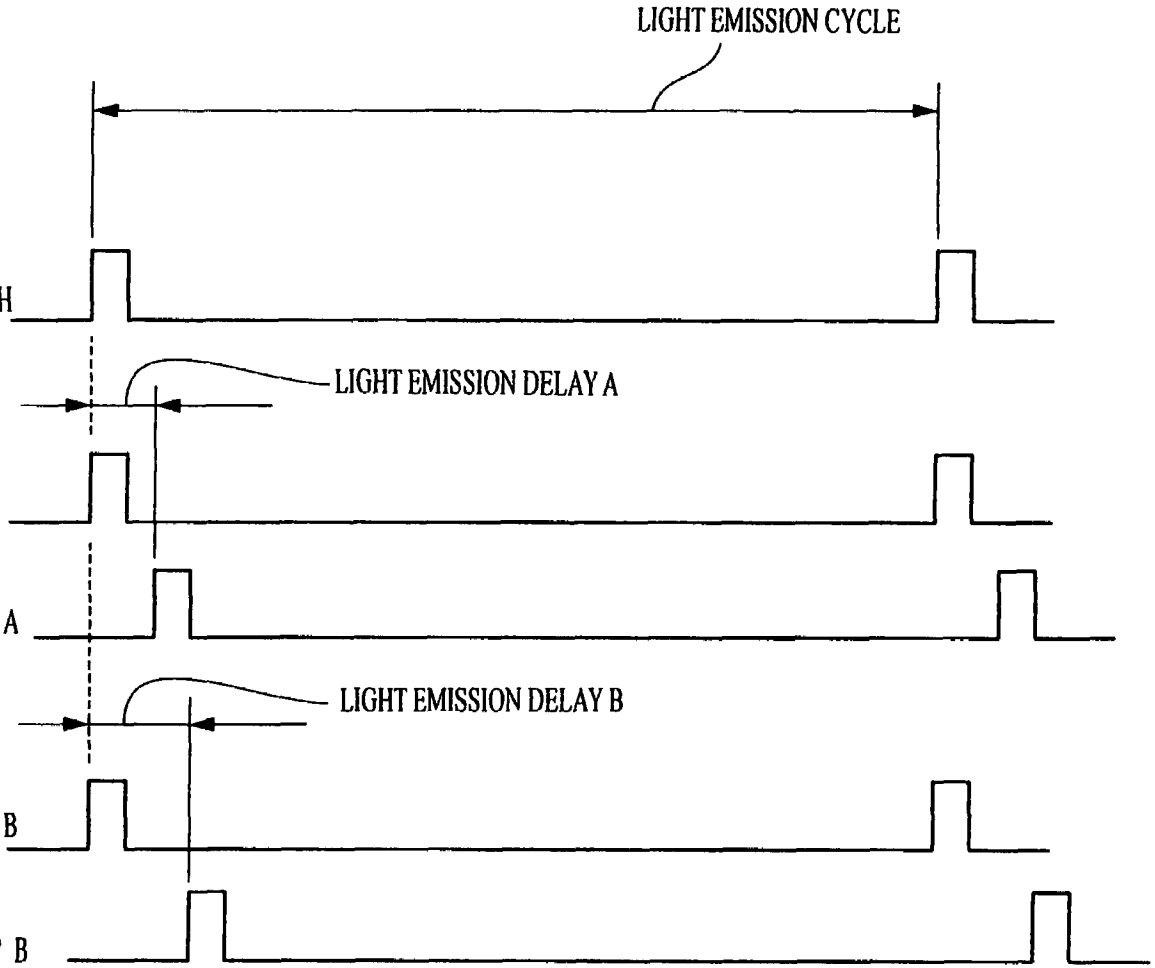
FIG. 9A to FIG. 9E are diagrams showing the light emission timing of the flash lamps according to the fourth embodiment.

The timing at which the electric current is supplied to the trigger electrodes of flash lamp groups A and B are shown in FIG. 9A. The thyristors 92 of flash lamp group A enter a state of conductivity in FIG. 9B, and the first light emission of flash lamp group A caused by the electric current being supplied from the condensers 62 is also shown. The thyristors 93 of flash lamp group A enter a state of conductivity in FIG. 9C, and the second light emission of flash lamp group A caused by the electric current being supplied from the condensers 63 is also shown.

The thyristors 92 of flash lamp group B enter a state of conductivity in FIG. 9D, and the first light emission of flash lamp group B caused by the electric current being supplied from the condensers 62 is also shown. The thyristors 93 of flash lamp group B enter a state of conductivity in FIG. 9E, and the second light emission of flash lamp group B caused by the electric current being supplied from the condensers 63 is also shown.

That is, as shown in FIG. 9A, electric current is supplied from the condensers 62 almost simultaneously as the electric current being provided to the trigger electrodes of flash lamp groups A and B, and their first light emissions are made to occur at preset timing (see FIGS. 9B and 9D).

Next, electric current is supplied from the condensers 63 at timing delayed only by the light emission delay A shown in FIG. 9B relative to the timing of the first light emission. A second light emission is performed at preset timing for flash lamp group A only (see FIG. 9C).

Further, electric current is supplied from the condensers 63 at timing delayed only by the light emission delay B shown in FIG. 9D (i.e., timing later than delay A) relative to the timing of the first light emission. Electric current is supplied from the condensers 63 and a second light emission is performed at preset timing for flash lamp group B (see FIG. 9E). In this example, the second light emission of flash lamp group B occurs almost simultaneously as completion of the second light emission of flash lamp group A (see FIGS. 9C and 9E).

In the examples shown in FIGS. 9A-9E, the first light emissions of flash lamp groups A and B are performed so as to occur simultaneously, and the second light emissions of flash lamp groups A and B are staggered. Accordingly, for each light emission cycle, the flash lamps 49 appear to flash light emissions three times.

Figures 10A, 10B, 10C, 10D, 10E, 10F:
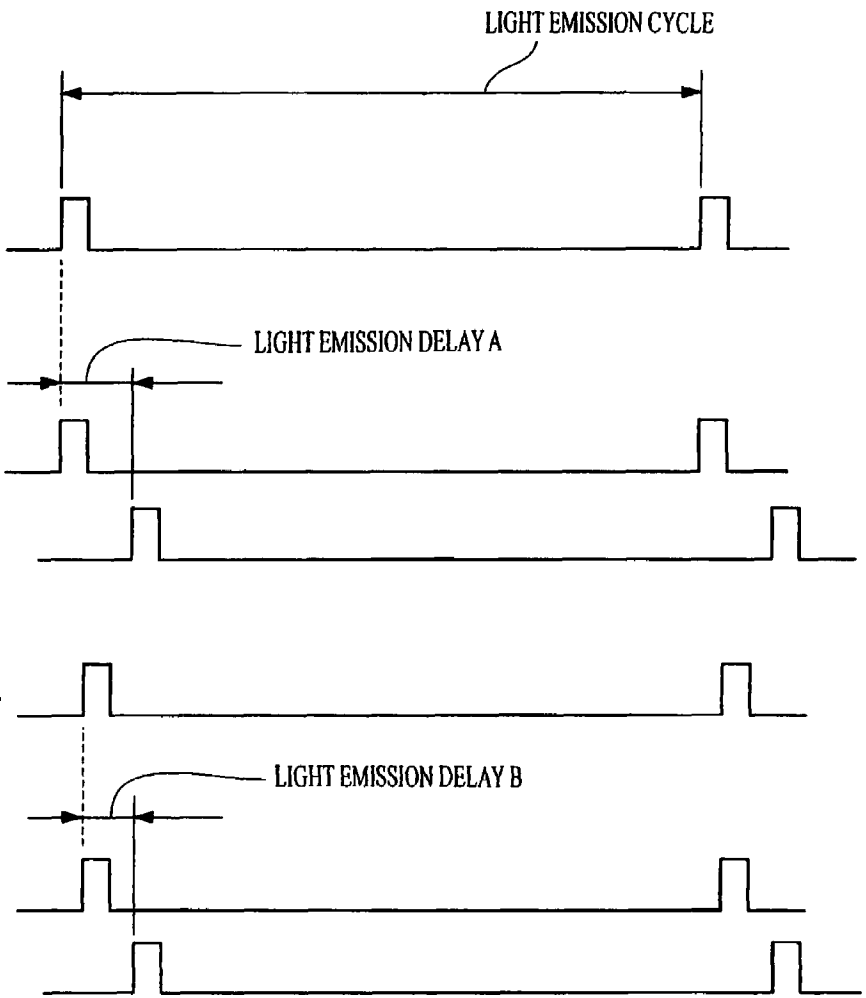
FIG. 10A to FIG. 10F are diagrams showing an alternate example of the light emission timing shown in FIG. 9A to FIG. 9E.

FIGS. 10A-10F show another flash light emission timing of this embodiment. The timing at which electric current is supplied to the trigger electrodes of flash lamp group A is shown in FIG. 10A. The thyristors 92 of flash lamp group A enter a state of conductivity in FIG. 10B and the first light emission of flash lamp group A caused by the electric current being supplied from the condensers 62 is also shown. The thyristors 93 of flash lamp group A enter a state of conductivity in FIG. 10C and the second light emission of flash lamp group A caused by the electric current being supplied from the condensers 63 is also shown.

The timing at which electric current is supplied to the trigger electrodes of flash lamp group B is shown in FIG. 10D. The thyristors 92 of flash lamp group B enter a state of conductivity in FIG. 10E and the first light emission of flash lamp group B caused by the electric current being supplied from the condensers 62 is also shown. The thyristors 93 of flash lamp group B enter a state of conductivity in FIG. 10F, and the second light emission of flash lamp group B caused by the electric current being supplied from the condensers 63 is also shown.

That is, as is shown in FIGS. 10A-10F, electric current is supplied from the condensers 62 almost simultaneously as the current being provided to the trigger electrode of flash lamp group A, and the first light emission of flash lamp group A only is made to occur at preset timing (see FIGS. 10A and 10B).

Next, electric current is supplied from the condensers 62 almost simultaneously as when the electric current is supplied to the trigger electrode of flash lamp group B, and the first light emission of flash lamp group B is performed at preset timing (see FIGS. 10D and 10E). In this example, the first light emission of flash lamp group B occurs almost simultaneously as completion of the first light emission of flash lamp group A (see FIGS. 10B and 10E).

Further, electric current is supplied from the condensers 63 at timing delayed only by the light emission delay A shown in FIG. 10B relative to the timing of the first light emission of flash lamp group A. A second light emission is performed at preset timing for flash lamp group A (see FIG. 10C). At the same time, electric current is supplied from the condensers 63 at timing delayed only by the light emission delay B shown in FIG. 10E relative to the timing of the first light emission of flash lamp group B (i.e., timing that is faster than the delay A). Electric current is supplied from the condensers 63 and the second light emission of flash lamp group B is made to occur at preset timing (see FIG. 10F).

In this example, the first light emissions of flash lamp groups A and B are staggered but their second light emissions are performed simultaneously.

Light is emitted two times at different timing in this manner for each light emission cycle, whereby even if there are four flash lamps, the same operational effect can be achieved as when a flash fixing unit provided with eight flash lamps is made to emit light flashes (i.e., the same effect as in the first embodiment). In addition, since the number of flash lamps can be reduced, the intervals between the adjacent flash lamps can be wider than in a case where there are eight flash lamps. For this reason, the adjacent flash lamps do not shield each other so there is no absorption or reflection of light from the flashes, whereby energy efficiency improves.

It should be noted that in the above descriptions, multiple flash lamps 49 of the flash fixing unit 47 are divided into a first flash lamp group and a second flash lamp group. Explanations of an example are given where the first and second flash lamp groups are made to emit light at different timing. Nonetheless, the present invention is not thus limited. For example, it is a given that the multiple flash lamps can be divided into three or more groups, and that the light flashes emitted from each flash lamp belonging to each group can be irradiated on each portion on the recording medium 12 at different timing. In addition, the supplying of energy due to the irradiation of the light flashes can be divided into multiple times over three times, and such variations apparently fall within the scope of the present invention.

Further, an example above was described where the present invention is applied to the fixing of a color toner image. Nonetheless, it is clear that the present invention is not thus limited and can be applied to fixing a monochromatic toner image.

Fifth Embodiment

The fifth embodiment of the present invention will be explained. It should be noted that components that are the same as in the first through fourth embodiments have been assigned the same numeric references, and the explanations thereon have been omitted.

Figure 11A:
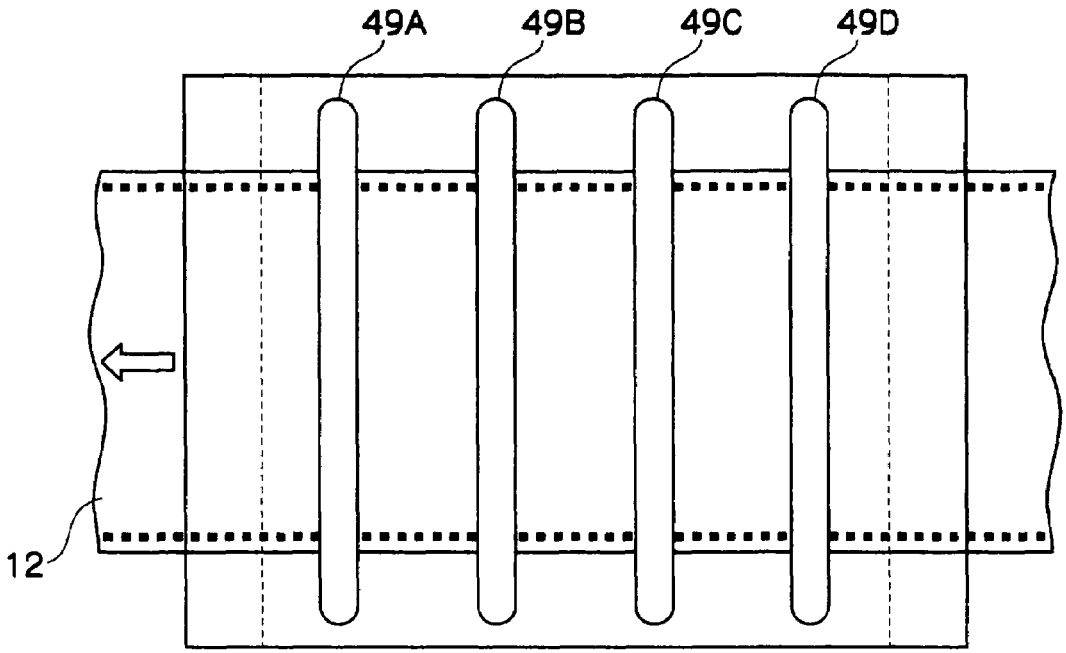
FIG. 11A and FIG. 11B are outlining structure drawings of a flash fixing unit according to a fifth embodiment.
Figure 11B:
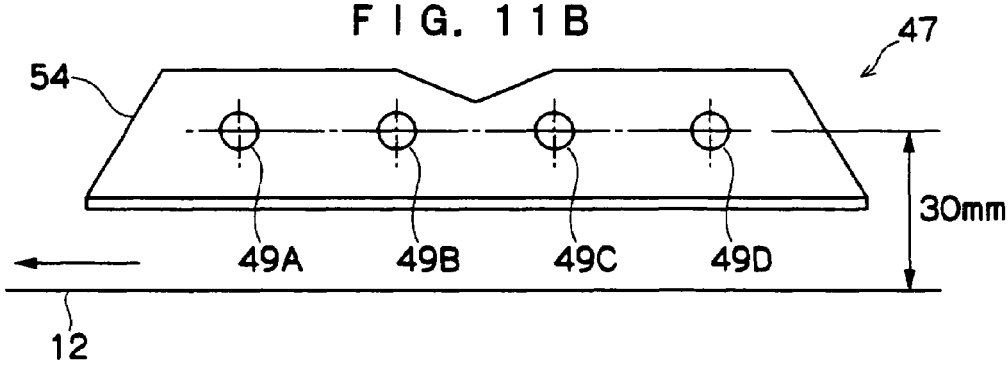

As shown in FIGS. 11A and 11B, the flash fixing unit 47 used in the fifth embodiment is provided with four flash lamps 49A-49D, as in the fourth embodiment. Each of the flash lamps 49A-49D are made so that their longitudinal directions face along the widthwise direction of the recording medium 12 (i.e., in the direction perpendicular to the direction in which the recording medium 12 is conveyed). These are arranged within a reflection board 54 along the conveying direction of the recording medium 12 at constant intervals. Further, each flash lamp is configured to have a distance with the conveyed recording medium 12 of, e.g., 30 mm.

Figure 12:
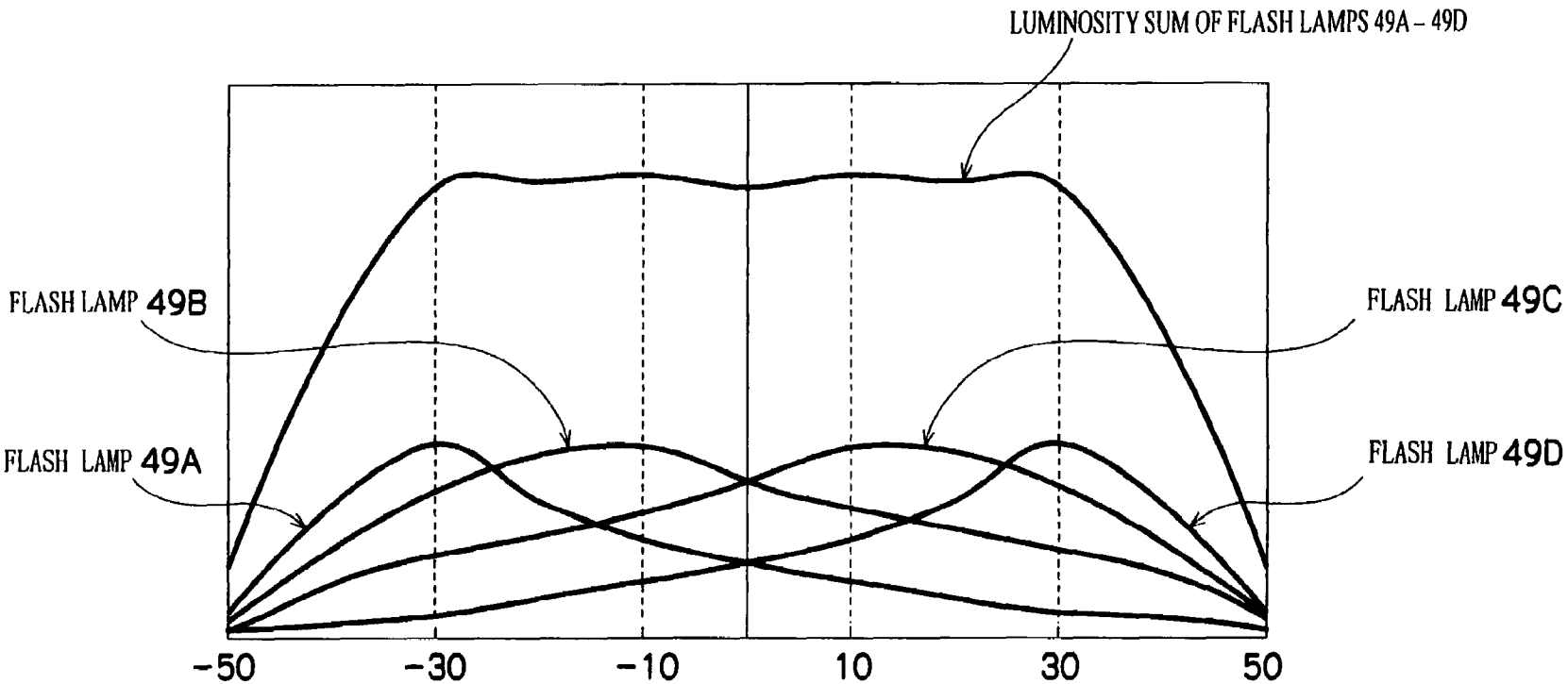
FIG. 12 is a diagram showing the luminosity distribution of light from flashes irradiated from the flash lamps of the fifth embodiment onto a recording medium.

The luminosity distribution of the light flash irradiated from each of the flash lamps 49A-49D onto the recording medium is shown in FIG. 12, and the entire luminosity distribution thereof is also shown.

The form and the like of the reflection board 54 are adjusted so that the luminosity (i.e., energy) of the light flash is distributed across almost the entire surface of the irradiation region of the recording medium 12 when each of the flash lamps 49 emits light.

The drive circuit in the first embodiment and shown in FIG. 3 is applied to illuminating each flash lamp 49 of the present embodiment. That is, the power circuit 108 and the trigger circuit 66 are each connected to each of the flash lamps 49, and the trigger circuits 66 are each connected to the illumination control circuit 88. The illumination control circuit 88 controls the lighting and extinguishing of each of the flash lamps 49. It should be noted that the constant number of circuits can be set as, for example, a voltage V=1600V, the condenser C=260 μF, and a coil L=440 μH.

The timing of the light emission in the present embodiment will be explained based on FIG. 13.

Figure 13:
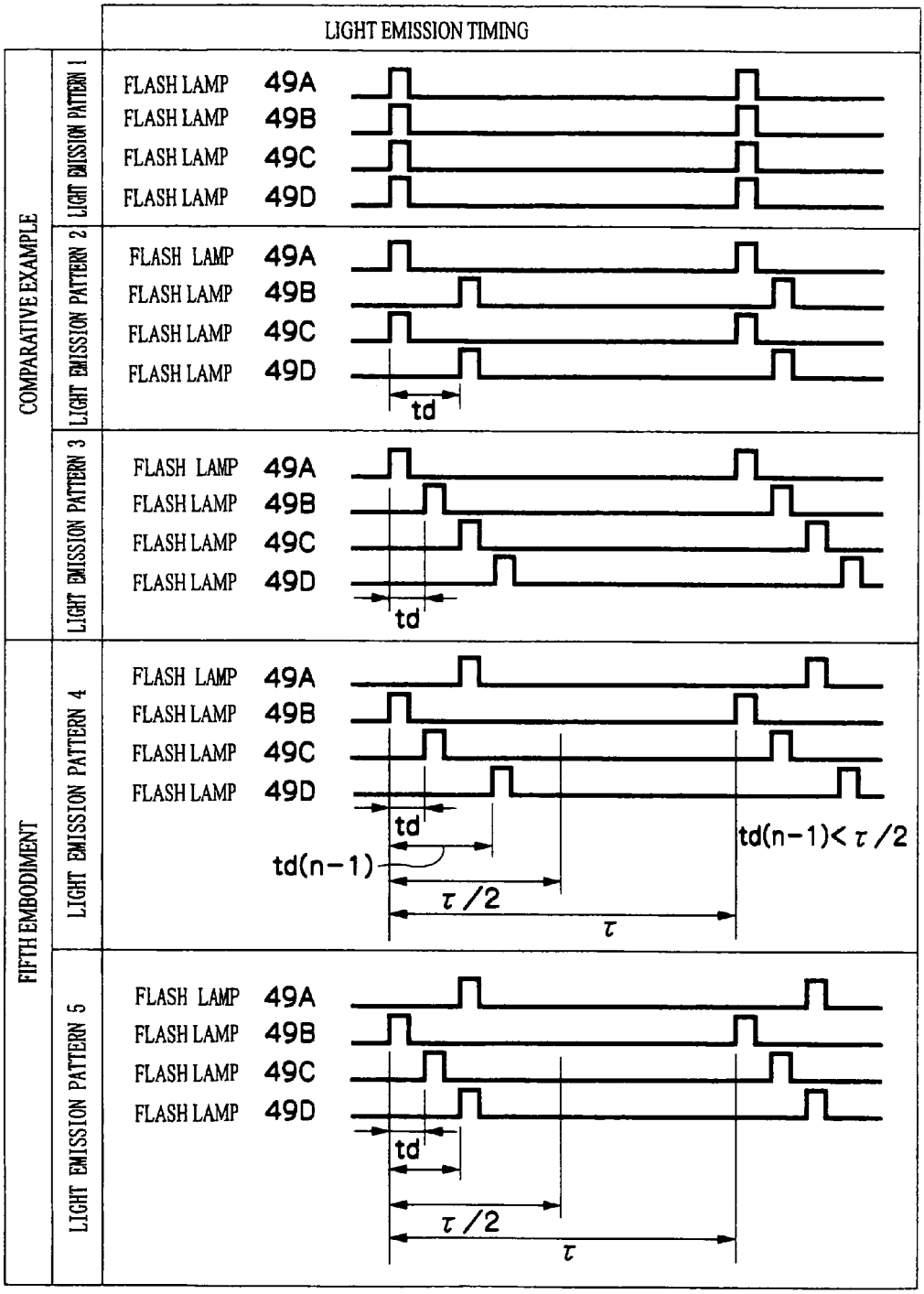
FIG. 13 is a diagram showing the light emission timing of the flash lamps according to the fifth embodiment.

In FIG. 13, the light emission timing of the present embodiment is shown in the light emission patterns 4 and 5. Examples of another light emission timing are shown in the light emission patterns 1-3.

The light emission timing shown in light emission pattern 1 shows the simultaneous light emission of each of the flash lamps 49A-49D.

Light emission pattern 2 is the pattern shown in the first embodiment. Flash lamps 49A, 49C are arranged as one group along the direction in which the recording medium 12 is conveyed, and flash lamps 49B, 49D are similarly arranged in another group, and each of the groups emit light at different timing. Although there were eight flash lamps in the first embodiment, there are four in light emission pattern 2.

Light emission pattern 3 is made to emit light from the downstream side of the conveying direction of the recording medium 12 at different timing in the order of arrangement, i.e., in the order of flash lamps 49A, 49B, 49C and 49D.

With light emission pattern 4, flash lamp 49B arranged in the central portion of the flash fixing unit 47 is first made to emit light, and then flash lamps 49C, 49A and 49D are made to emit light in this order. It should be noted that as a variation of this pattern, flash lamp 49C can be made to emit light first, followed by flash lamps 49B, 49D and 49A made to emit light in this order.

With light emission pattern 5, flash lamp 49B is first made to emit light, and next flash lamp 49C, and then flash lamps 49A and 49D are made to emit light simultaneously. It should be noted that as a variation of this pattern, flash lamp 49C can be made to emit light first, followed by flash lamp 49B, and next flash lamps 49A and 49D can be made to emit light simultaneously.

That is, each of the flash lamps 49 in light emission patterns 4 and 5 are made to emit light such that there is a delay from the flash lamps arranged in the central portion towards the direction of both ends.

It should be noted that the light emission delay td of each flash lamp 49 is 4 ms in light emission pattern 2 and 2 ms in light emission pattern 3.

Further, the light emission delay td of light emission patterns 4 and 5 is 2 ms. One flash lamp starts to emit light flash and the irradiation luminosity of the light flash reaches a peak at the irradiated portion on the recording medium 12, then the light emission of the next flash lamp is set to initiate.

Further, with light emission patterns 4 and 5, the time from the light emission of the first flash lamp (flash lamp 49B) until the light emission of the last flash lamp (in light emission pattern 4, flash lamp 49D, in light emission pattern 5, flash lamps 49A and 49D) is made to be less than half the light emission cycle $\tau$ of each flash lamp. By setting the light emission intervals in this manner, the toner temperature can be maintained to slightly exceed the fusing temperature for a relatively long period of time.

Simulation results where the above-described light emission patterns 1-5 are compared will be explained based on the drawings in FIGS. 14-16.

Figures 14A, 14B:
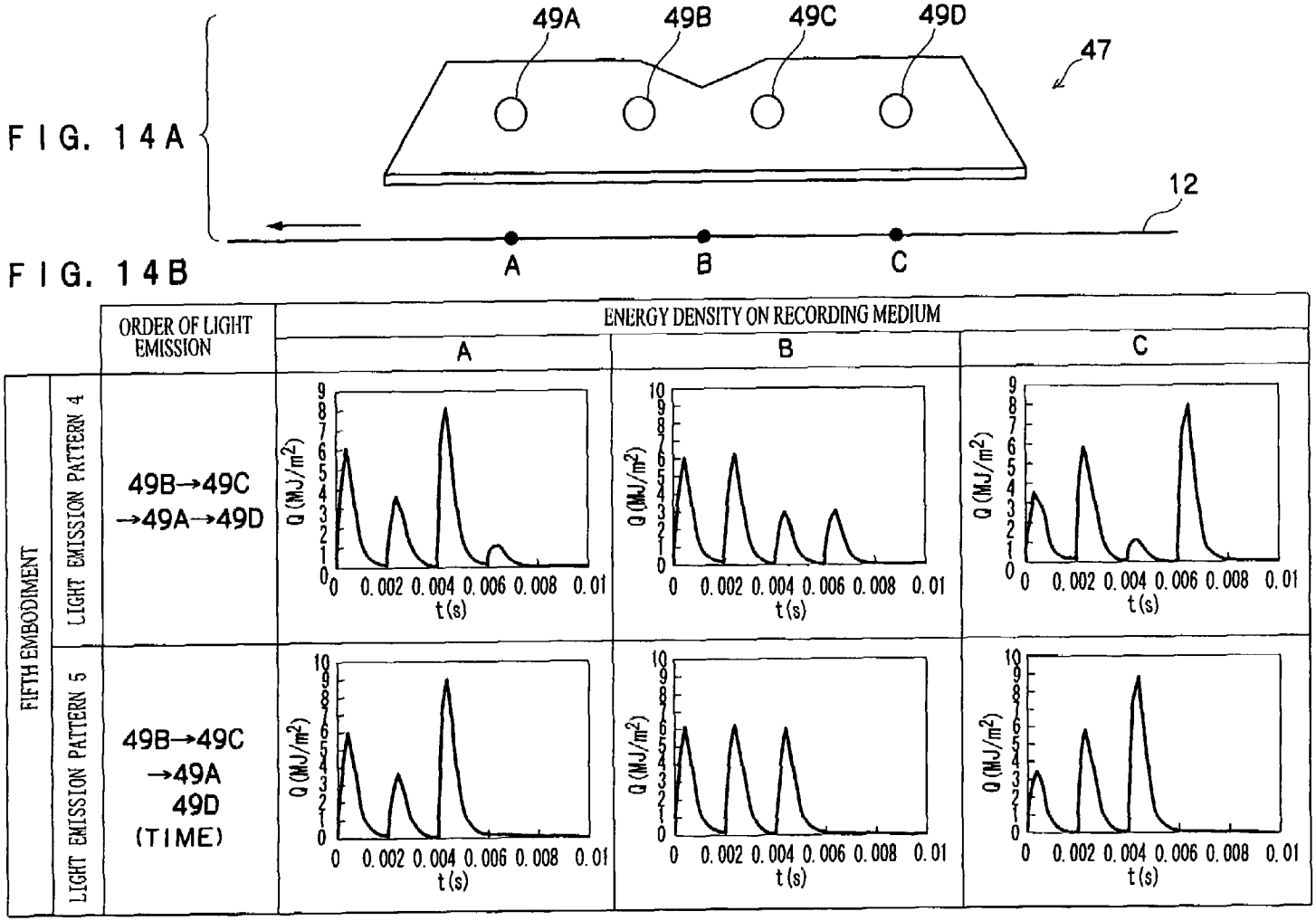
FIGS. 14A and 14B are diagrams showing the energy density of the light from the flashes at Points A, B and C on the recording medium in light emission patterns 4 and 5 indicated in FIG. 13.

As shown in FIG. 14A, the energy density of the light from the flashes is sought for each of the light emission patterns 1-5 at Point A on the recording medium positioned directly beneath flash lamp 49A; at Point C on the recording medium positioned directly beneath flash lamp 49D; and at Point B positioned between Points A and C. The results are shown in FIGS. 14B and 15 (the heat quantity per 1 $m^2$ is shown at the vertical axis and the time (in seconds) is shown at the horizontal axis).

Insufficient flash fixing occurs if there is insufficient energy, while excessive energy causes image deterioration such as dot splotches (white points), the release of smoke, and strange odors. Accordingly, it is preferable to almost equally supply the appropriate amount of energy to the recording medium at a certain time (i.e., from several to several dozen ms).

Figure 15:
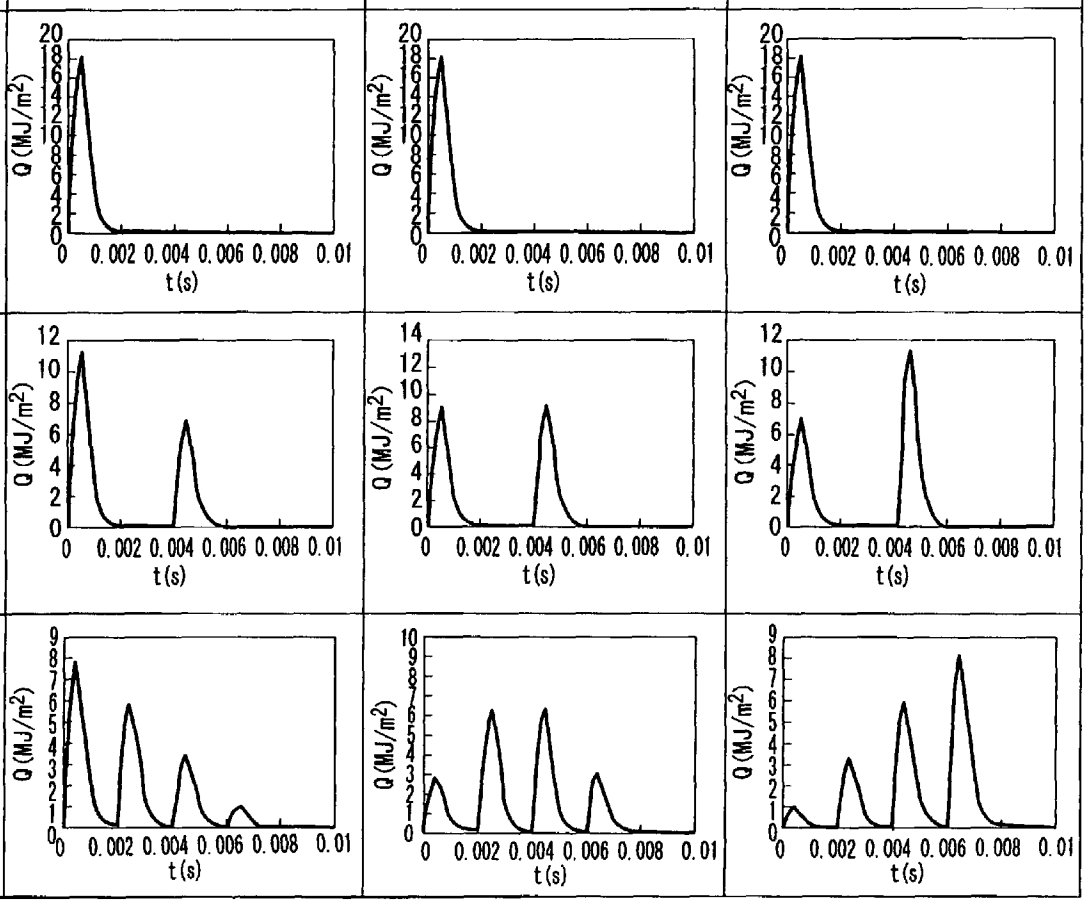
FIG. 15 is a diagram showing the energy density of the light from the flashes at Points A, B and C on the recording medium in light emission patterns 1-3 indicated in FIG. 13.

With light emission pattern 1, the time is short, such as approximately 1 ms, and a large quantity of energy such as approximately 18 $MJ/m^2$ is irradiated as shown in FIG. 15. In contrast, in light emission patterns 3-5, divided irradiations into several times are performed. The energy is almost equally imparted to the recording medium at certain timing (i.e., from several to several dozen ms) as shown in FIGS. 14B and 15.

As shown in FIG. 14B, in light emission pattern 4 of the present embodiment, energy is irradiated evenly (at most, approximately 8 $MJ/m^2$) for the duration of approximately 7 ms. Further, in light emission pattern 5 of the present embodiment, energy is irradiated evenly (at most, approximately 9 $MJ/m^2$) for the duration of approximately 5 ms.

Figure 16A:
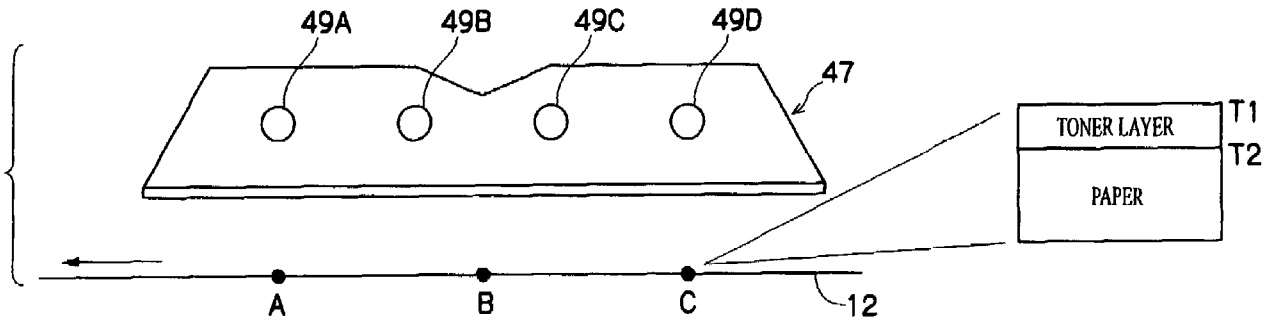
FIG. 16A and FIG. 16B are diagrams showing the temperature change (T1) at the surface of the toner layer and the temperature change (T2) at the surface boundary of a recording medium that receive the energy shown in FIG. 14 and are heated in light emission patterns 4 and 5 indicated in FIG. 13.
Figure 16B:
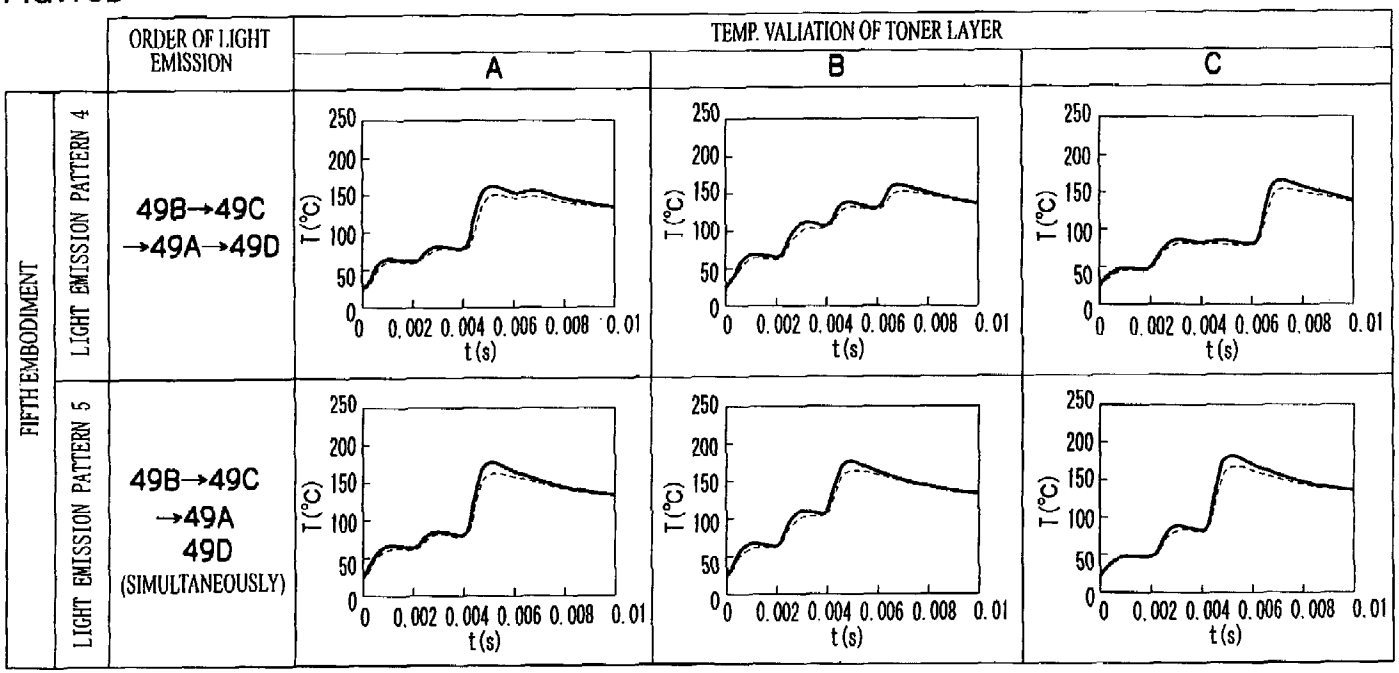
Figure 17:
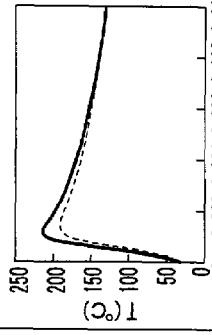
FIG. 17 is a diagram showing the temperature change (T1) at the surface of the toner layer and the temperature change (T2) at the surface boundary of a recording medium that receive the energy shown in FIG. 15 and are heated in light emission patterns 1-3 indicated in FIG. 13.
Figure 17:
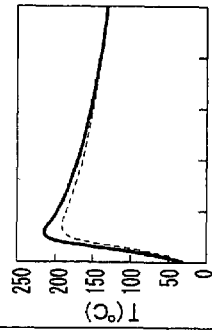
Figure 17:
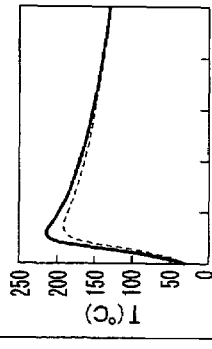
Figure 17:
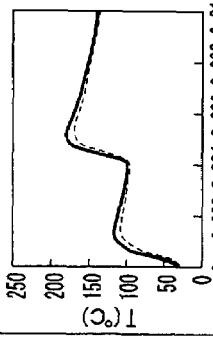
Figure 17:
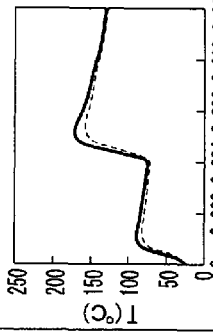
Figure 17:
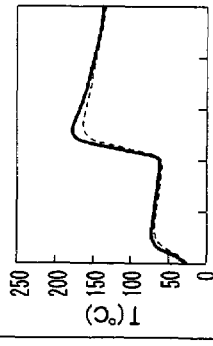
Figure 17:
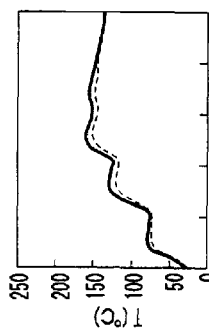
Figure 17:
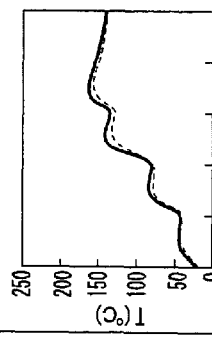
Figure 17:
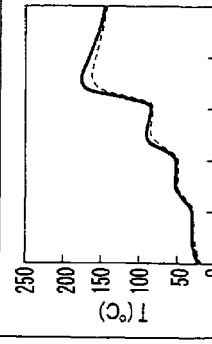

As shown in FIG. 16A, the temperature change (T1) at the surface of the toner layer which is heated with the energy shown in FIGS. 14B and 15, and the temperature change (T2) at the surface boundary of the recording medium 12 are sought at the same Points A-C. The results are shown in FIGS. 16B and 17 (where the temperature is shown at the vertical axis and the time (in seconds) is shown at the horizontal axis). In the drawings, the solid line shows the temperature change for T1 and the dotted line shows the temperature change for T2.

As shown in FIGS. 16B and 17, there are differences on the temperature rise curve and the highest temperature reached depending on the light emission pattern and the position on the recording medium 12.

Figure 18:
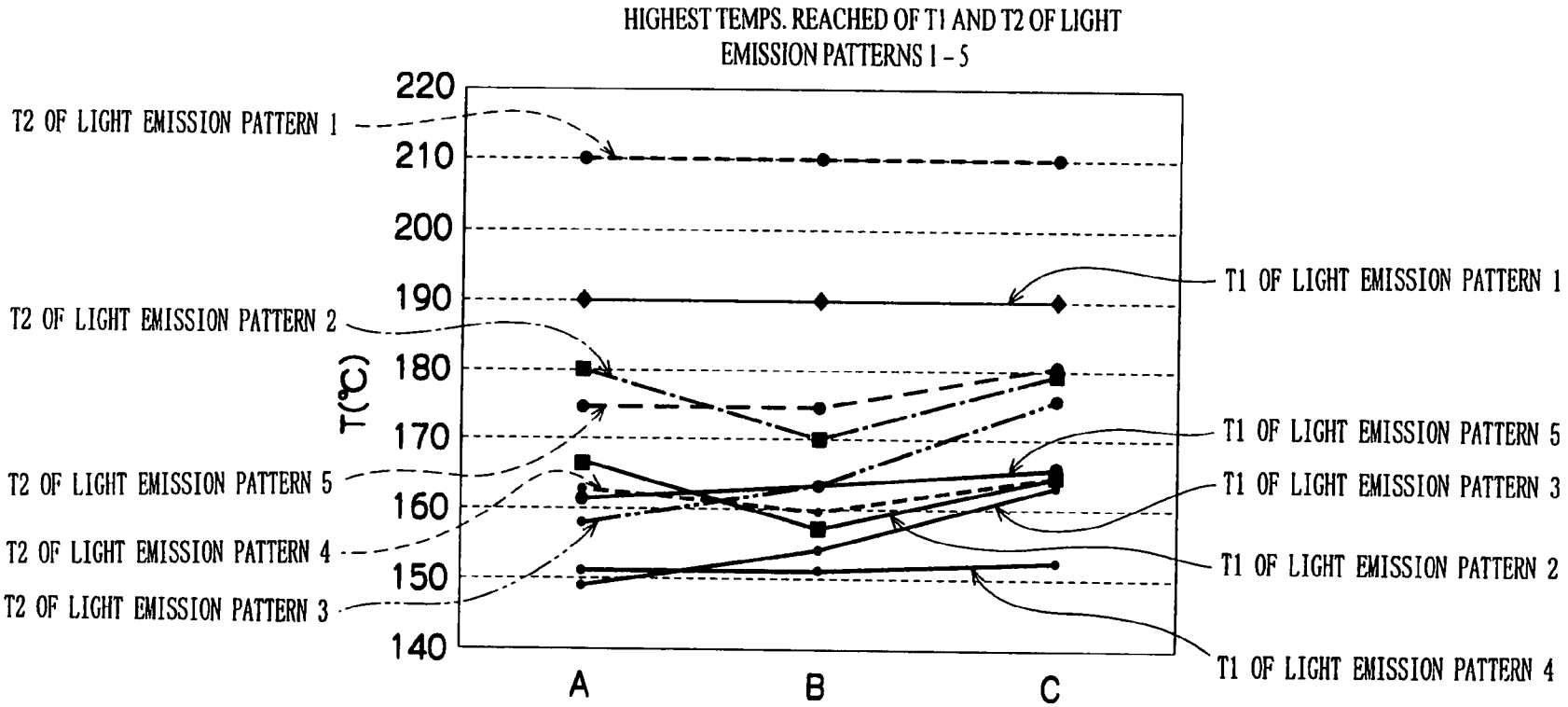
FIG. 18 shows the temperatures extracted from the highest temperatures reached of T1, T2 shown in FIGS. 16 and 17.

The greatest temperatures reached in T1, T2 of respective light emission patterns 1 to 5 shown in FIGS. 16B and 17 are extracted and shown in FIG. 18.

The factor that most affects the fixing qualities is the greatest temperature reached for T2 at the surface boundary of the recording medium 12. It is necessary that the greatest temperature reached for T2 is substantially equal to or greater than the temperature sufficient for fusing the toner, and that it be substantially constant regardless of the position on the recording medium 12. These conditions depend on the toner and the recording medium, however, good toner fixation can be achieved if the greatest temperature of the T2 reached should be 130° C. or more (preferably 140° C. or more) and the temperature irregularity of the greatest temperature reached for T2 at the position on the recording medium 12 is 10° C. or less (preferably 5° C. or less).

The smoke and strange odors is mainly caused by the sublimation of the component material of the toner brought by the excessive surface temperature T1 rise. It is known that these problems occur when the greatest temperature for T1 achieved reaches the vicinity of 300° C., however, it is desirable to keep this temperature in the range of 200° C. so as to avoid influence on the environment.

Further, areas where the dots are missing (i.e., white portions) are more likely to occur when the temperature difference between the greatest temperature of T1 and the greatest temperature of T2 is too great. This also depends on the material quality of the toner and the layer thickness, however, it is generally preferable that the temperature difference between the two be 40° C. or less (more preferably, 20° C. or less).

The greatest temperature reached for T1 with light emission pattern 1 is over 200° C., whereas the greatest temperature reached for T1 with light emission pattern 4 of the present embodiment is approximately 165° C., and the greatest temperature reached for T1 with light emission pattern 5 is approximately 180° C.

Further, with light emission patterns 2 and 3, the temperature deviation of the greatest temperature reached for T2 at Points A, B and C on the recording medium 12 is in the range of 10° C., whereas the temperature deviation with light emission patterns 4 and 5 of the present embodiment is approximately 5° C.

It is generally determined from the above-described results that good results can be obtained with light emission patterns 4 and 5 according to the present embodiment. Particular note should be taken that with light emission pattern 5, the smallest peak of light emission pattern 4 hardly contributed to the heating thereof, and that the light emissions of flash lamps 49A, 49D at separate positions are changed so as to be simultaneous. As a result, the heat efficiency improves and, in comparison with light emission pattern 4, the highest T2 temperature reached increases by 10° C. or more. According to the result, it is understood that the inputted energy can be lowered from the existing condition and the distances between each of the flash lamps 49 and the recording medium 12 can be increased due to the simultaneous emission of light from the flash lamps 49 that are positioned separately. The present embodiment thus performs excellent results such as energy saving, even light distribution and reduced heat stress.

Figure 19:
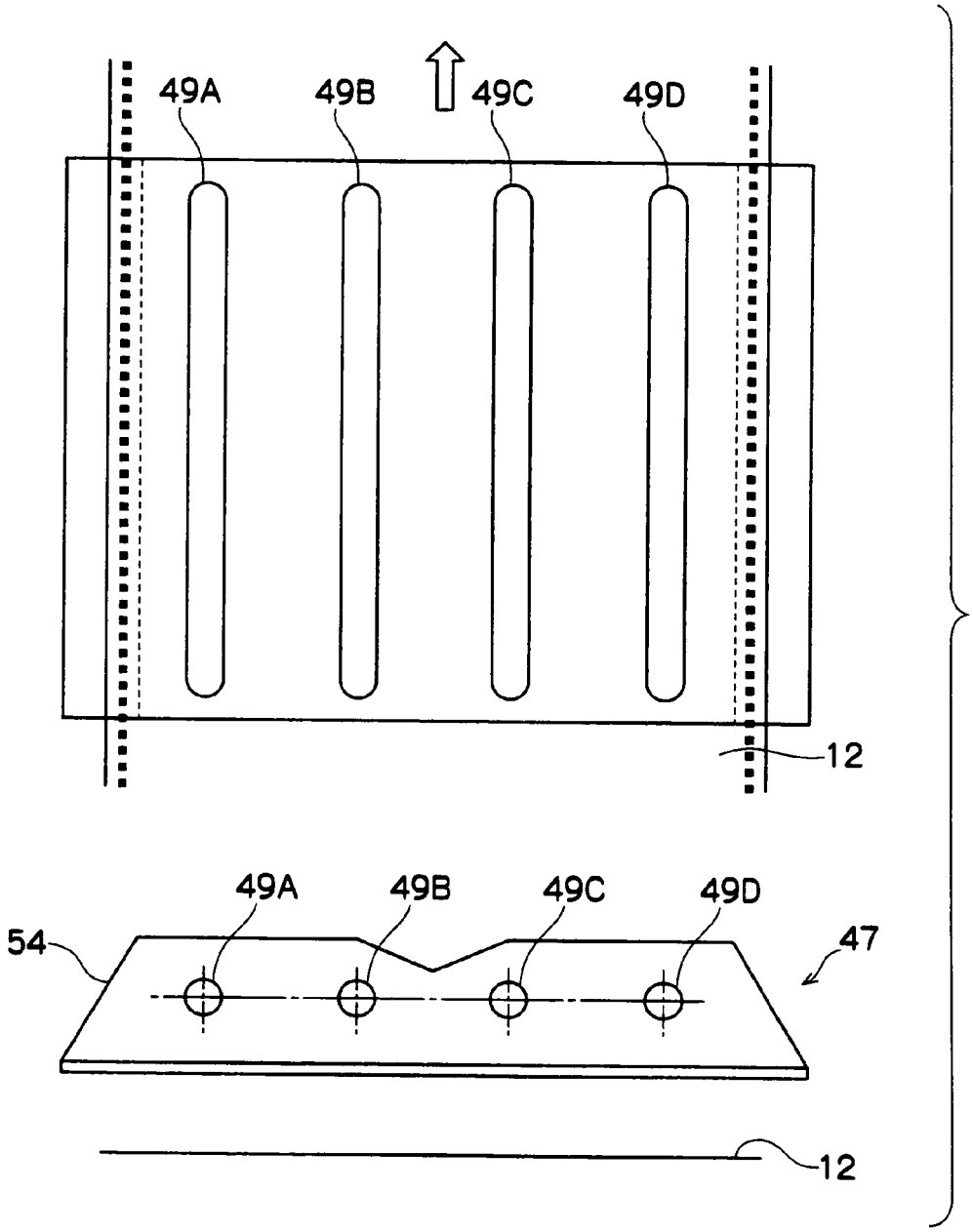
FIG. 19 is an alternate example of a flash fixing unit according to the fifth embodiment.

It should be noted that, as shown in FIG. 19, the flash lamps 49 are faced so that their longitudinal direction follows along the direction in which the recording medium 12 is conveyed. Nonetheless, these can also be arranged within the reflection board 54 at constant intervals along the widthwise direction of the recording medium 12. Even in this case, the same effects can be obtained.

Sixth Embodiment

The sixth embodiment of the present invention will be explained. Portions that are the same as in the first through fifth embodiments have been assigned the same numeric references, and explanations thereon have been omitted.

Figure 20:
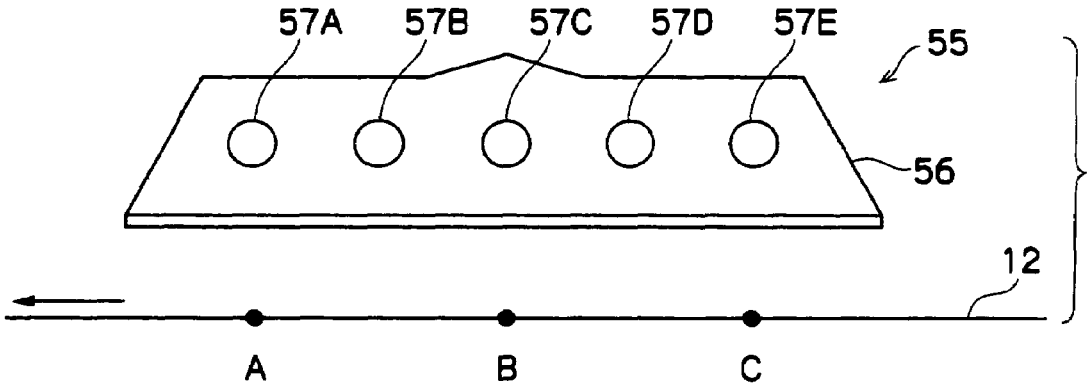
FIG. 20 is an outline drawing of a flash fixing unit according to a sixth embodiment.

As shown in FIG. 20, the flash fixing unit 55 used in the sixth embodiment is provided with five flash lamps 57A-57E. Each of the flash lamps 57 are faced so their longitudinal directions follow along the widthwise direction of the recording medium 12 (i.e., in the direction that is perpendicular to the direction in which the recording medium 12 is conveyed) and the flash lamps 57 are arranged within the reflection board 56 at constant intervals along the direction in which the recording medium 12 is conveyed. Further, as in the fifth embodiment, each of the flash lamps 57 is configured so that their distance relative to the conveyed recording medium 12 is, e.g., 30 mm.

The drive circuit shown in FIG. 3 and explained in the first embodiment is applied to illuminating each flash lamp 57 of the present embodiment. That is, the power circuit 108 and the trigger circuit 66 are each connected to each flash lamp 57, and the trigger circuits 66 are each connected to the illumination control circuit 88. The illumination control circuit 88 controls the lighting and extinguishing each flash lamp 57. It should be noted that the constant number of circuits can be set as in the fifth embodiment, for example, a voltage V=1600V, the condenser C=260 μF, and a coil L=440 μH.

The light emission timing in the present embodiment will be explained based on FIG. 21.

Figure 21:
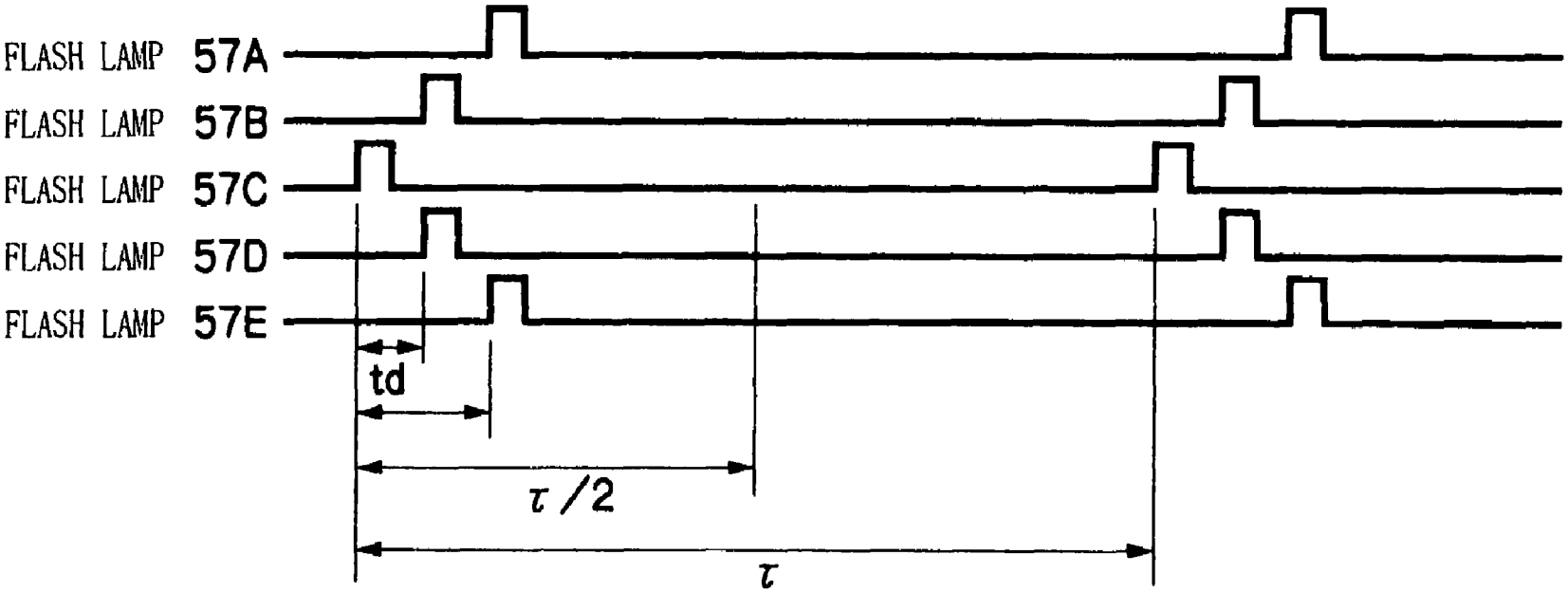
FIG. 21 is a diagram showing the light emission timing of the flash lamps according to the sixth embodiment.

With the present embodiment, as shown in FIG. 21, the flash lamp 57C is first made to emit light, next the flash lamps 57B, 57D are made to emit light simultaneously, and finally the flash lamps 57A, 57E are made to emit light simultaneously. That is, the light emission delay td of each flash lamp 57 is 2 ms.

Further, as in the fifth embodiment, the time from the light emission of the first flash lamp (flash lamp 57C) until the light emission of the last flash lamps (flash lamps 57A and 57E) is made to be less than half the light emission cycle τ of each lamp.

Figure 22:
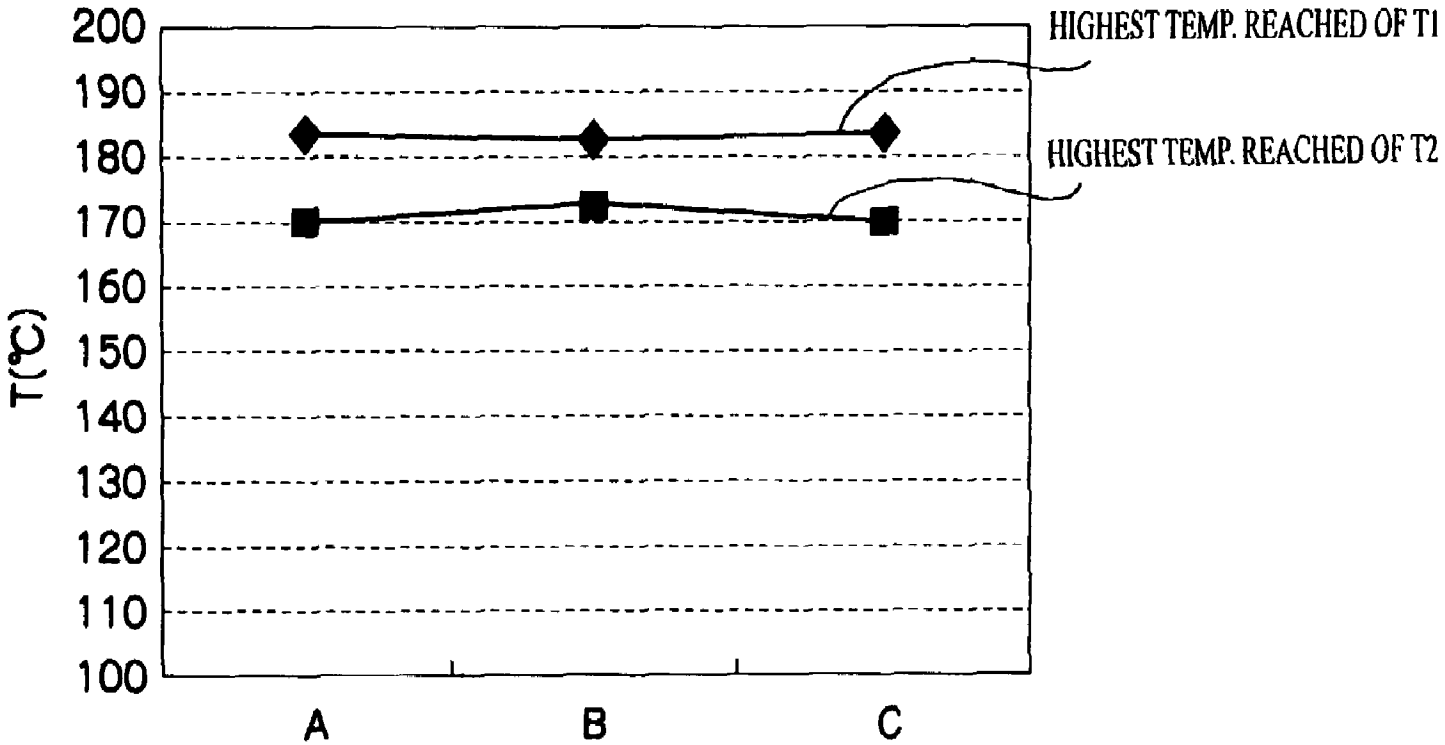
FIG. 22 is a diagram showing the highest temperatures reached for each of the temperature change (T1) at the surface of the toner layer and the temperature change (T2) at the surface boundary of the recording medium according to the sixth embodiment.

The results of the temperature changes for (T1) at the surface of the toner layer and the temperature change (T2) at the surface boundary of the recording medium at Points A-C on the recording medium 12 are shown in FIG. 22.

With the present embodiment, the greatest T1 temperature reached is 183-184° C., and for T2 it is 170-172° C. The temperature irregularity between each point of the greatest T2 temperature reached is 2° C., and the temperature difference between the greatest temperatures reached for T1 and T2 is 14° C. As a result, substantially even heating is achieved regardless of the position of the recording medium 12 and good fixing quality is obtained. The light emission pattern of this embodiment is close to that of light emission pattern 5 of the fifth embodiment, but since there are an odd number of flash lamps, the heating balance is improved.

Seventh Embodiment

The seventh embodiment of the present invention will be explained. It should be noted that portions of this embodiment that are the same as in the first through sixth embodiments have been assigned the same numeric references, and explanations thereon have been omitted.

Figure 23:
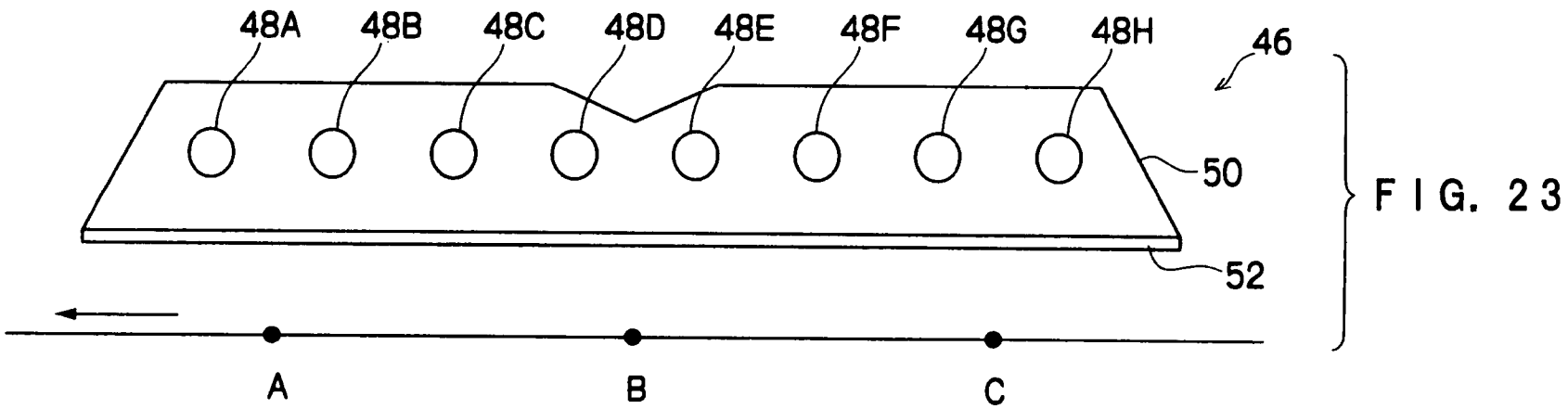
FIG. 23 is an outline drawing of a flash fixing unit according to a seventh embodiment.

As shown in FIG. 23, the flash fixing unit 46 used in the seventh embodiment is provided with eight flash lamps 48A-48H, as in the first embodiment. Each flash lamp 48 is faced so that its longitudinal direction follows along the widthwise direction of the recording medium 12 (i.e., in the direction that is perpendicular to the direction in which the recording medium 12 is conveyed) and the flash lamps 48 are arranged within the reflecting board 50 at constant intervals along the direction in which the recording medium 12 is conveyed.

In the case of a high-speed printer where the process speed exceeds 1000 mm/second, it is necessary to provide many flash lamps and to fix the toner at one time across a large area since the light emission cycles cannot keep up with the speed. However, when the number of flash lamps has been increased, it may become very difficult to design a reflection board so that substantially even luminosity (i.e., energy) can be distributed across the entire surface of the irradiation region. Each of the flash lamps 48 is configured so that their distance relative to the conveyed recording medium 12 is, e.g., 90 mm, in order to reduce energy density irregularities on the recording medium 12.

The drive circuit shown in FIG. 3 and explained in the first embodiment is applied to illuminate each flash lamp 48 of the present embodiment. That is, the power circuit 108 and trigger circuit 66 are each connected to each of the flash lamps 48, and the trigger circuits 66 are each connected to the illumination control circuit 88. The illumination control circuit 88 controls the lighting and extinguishing of each of the flash lamps 48. It should be noted that the constant number of circuits can be set as, for example, a voltage V=1700V, the condenser C=260 μF, and a coil L=440 μH. Here, the voltage is increased more than in the fifth and sixth embodiments, and this is to make up for the reduced energy being generated due to the increased distance between the flash lamps 48 and the recording medium 12.

Figure 24:
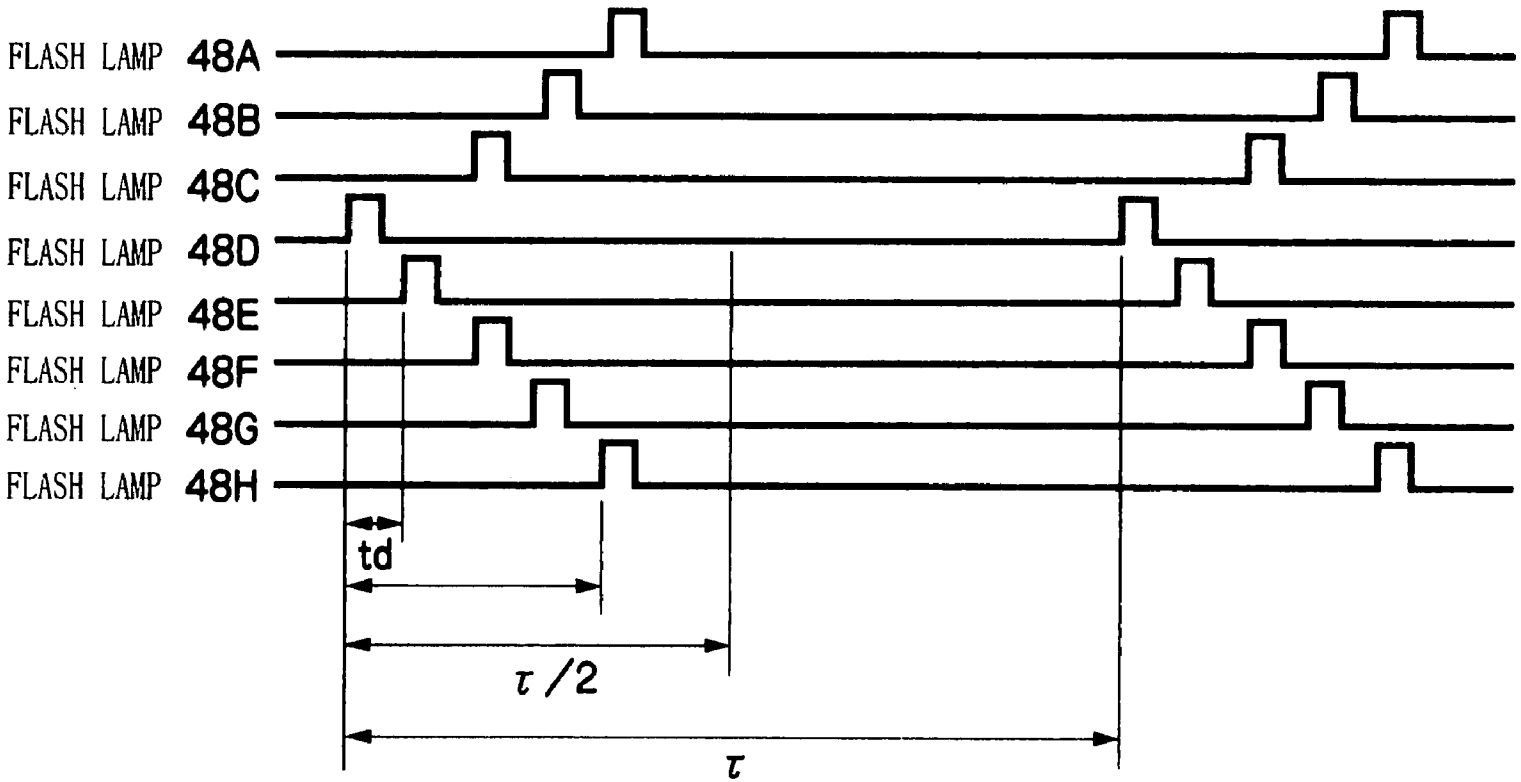
FIG. 24 is a drawing showing the light emission timing of the flash lamps according to the seventh embodiment.

The light emission timing in the present embodiment will be explained based on FIG. 24.

In the present embodiment, flash lamp 48D is first made to emit light, followed by flash lamp 48E. Next, flash lamps 48C, 48F are made to emit light simultaneously, next flash lamps 48B, 48G are made to emit light simultaneously, and next flash lamps 48A, 48H are made to emit light simultaneously. Here, the light emission delay td for each flash lamp 48 is 1 ms.

Further, as in the fifth embodiment, the time from the light emission of the first flash lamp (flash lamp 48D) until the light emission of the last flash lamps (flash lamps 48A and 48H) is made to be less than half the light emission cycle $\tau$ of each flash lamp.

Figure 25:
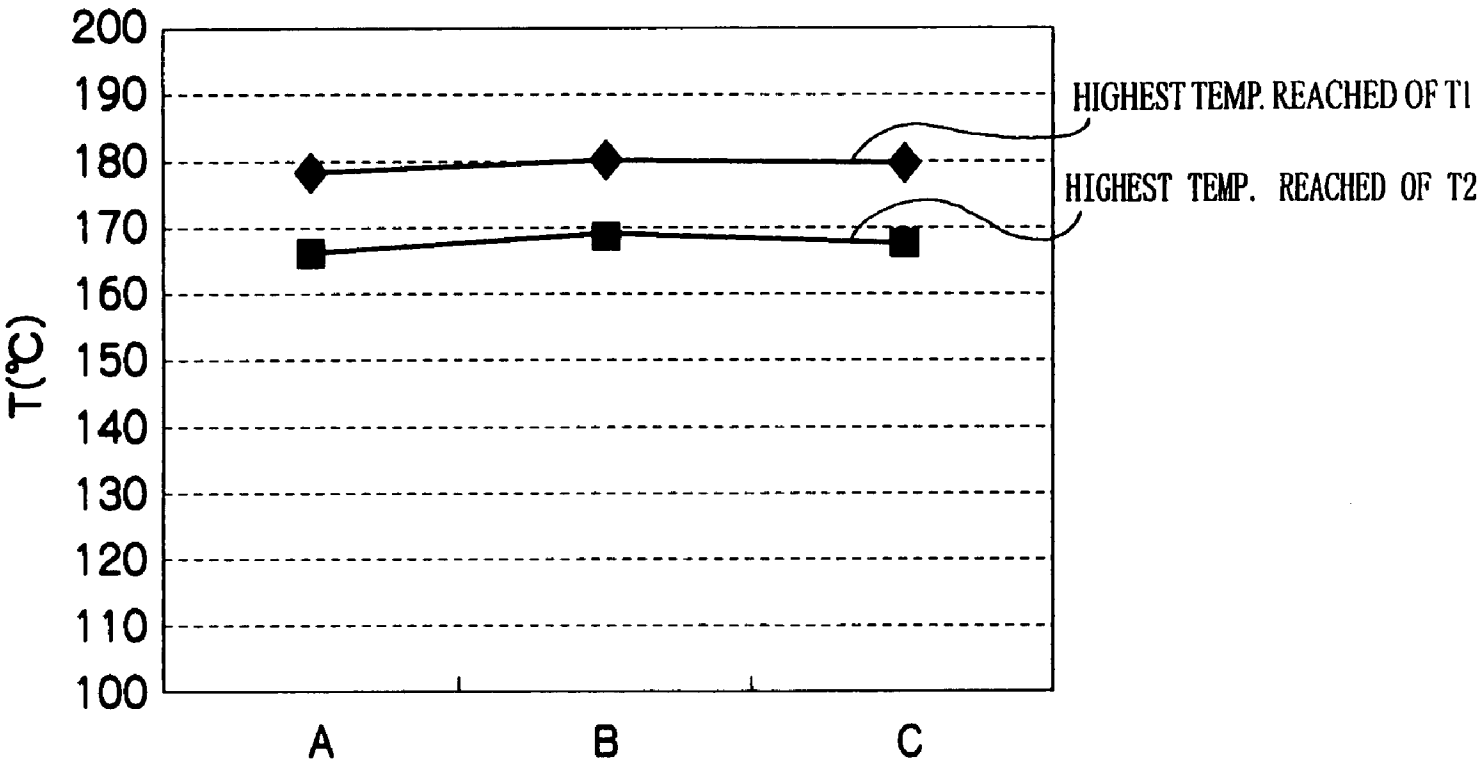
FIG. 25 is a diagram showing the highest temperatures reached for each of the temperature change (T1) at the surface of the toner layer and the temperature change (T2) at the surface boundary of the recording medium according to the seventh embodiment.

The greatest temperatures reached for the temperature change (T1) at the surface of the toner layer and the temperature change (T2) at the surface boundary of the recording medium 12 at Points A-C on the recording medium 12 (see FIG. 23) are sought. The results are shown in FIG. 25.

With the present embodiment, the greatest temperature reached for T1 is 178-181° C., and for T2 it is 166-168° C. The temperature irregularity between each point of the greatest T2 temperature reached is 2° C., and the temperature difference between the greatest temperatures reached for T1 and T2 is 13° C. As a result, substantially even heating is achieved regardless of the position of the recording medium 12 and good fixing quality is obtained.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A flash fixing device comprising:

first and second flash lamps that emit light flashes that fix a toner image transferred onto a recording medium; and a light emission control unit that controls the light emission of the first and second flash lamps so that the light flashes emitted from the first flash lamp and the light flashes emitted from the second flash lamp are each irradiated at different timing on respective portions of the recording medium onto which the toner image is transferred, wherein the light emission control unit controls the light emission of the first and second flash lamps so that the first and second flash lamps each emit light at constant cycles, and so that a difference in irradiation timing of the light flashes from the first and second flash lamps to the same portion on the recording medium is less than half the light emission cycle of the first and second flash lamps.

2. The flash fixing device of claim 1, wherein the toner image to be fixed is a color toner image comprising toner images of multiple colors that is overlapped.

3. The flash fixing device of claim 1, wherein the difference in the irradiation timing is set such that irradiation of a second light flash starts after irradiation of a first light flash on a given portion, and within a period between the irradiated luminosity of the first light flash on the given portion reaching a peak and returning to zero.

4. The flash fixing device of claim 1, wherein a plurality of first and second flash lamps are provided and arranged alternately one-by-one along a preset direction, and the light emission control unit makes a first flash lamp group emit light simultaneously and makes a second flash lamp group emit light simultaneously.

5. The flash fixing device of claim 4, wherein the plurality of first and second flash lamps are arranged so that some adjacent flash lamps are separated by a first interval, other adjacent flash lamps are separated by a second interval that is smaller than the first interval, and the flash lamps respectively separated by the first interval and the second interval alternate along a preset direction; and the light emission control unit controls the light emission of the first and second flash lamp groups so that the light flashes from adjacent first flash lamps and second flash lamps separated by the second interval are irradiated in substantially the same range on the recording medium.

6. The flash fixing device of claim 1, wherein the light emission control unit controls the light emission of the first and second flash lamps so that at least one of the peak and variation pattern of the energy applied to the toner by the respective light emission of the first flash lamp and the second flash lamp is different.

7. The flash fixing device of claim 6, wherein the light emission control unit makes a voltage supplied to the first flash lamp differ from a voltage supplied to the second flash lamp.

8. The flash fixing device of claim 6, wherein the light emission control unit is configured to include condensers respectively connected in parallel to each of the flash lamps, and the respective static electric capacity of a first condenser connected to the first flash lamp and a second condenser connected to the second flash lamp are different.

9. The flash fixing device of claim 6, wherein the light emission control unit is configured to include choke coils respectively connected in series to each of the flash lamps, and the respective inductance of a first choke coil connected to the first flash lamp and a second choke coil connected to the second flash lamp are different.

10. The flash fixing device of claim 1, wherein the light emission control unit controls the light emission of the first and second flash lamps so that each of the first and second flash lamps emit light multiple times per respective light emission cycle and at least one of the multiple light emissions of the first flash lamp is irradiated at a different timing from the multiple light emissions of the second flash lamp.

11. The flash fixing device of claim 1, comprising a flash lamp group where three or more of the first and second flash lamps are arranged along a preset direction, wherein the first flash lamp is arranged in a central portion of the flash lamp group and other flash lamps are arranged at either end of the first flash lamp, and the light emission control unit controls the light emission of each flash lamp in the flash lamp group so that the further a flash lamp is located in either direction from the first flash lamp of the central portion the more the irradiation timing of the flash lamp is delayed.

12. The flash fixing device of claim 11, wherein the light emission control unit controls the light emission so that light flashes from the other flash lamps arranged at one end of the first flash lamp and light flashes from the other flash lamps arranged at the other end of the first flash lamp are irradiated simultaneously.

13. The flash fixing device of claim 11, wherein the irradiation timing delay of the light flashes emitted from each flash lamp in the flash lamp group is set such that after irradiation of one light flash on a given portion on the recording medium starts, irradiation of a next light flash starts after the irradiation luminosity of the one light flash reaches a peak.

14. The flash fixing device of claim 11, wherein the light emission control unit controls the light emission so that each flash lamp in the flash lamp group emits light at a constant cycle, and the irradiation timing delay between the light flashes of the first flash lamp and the last light flashes emitted by the other flash lamps is less than half the light emission cycle of each of the flash lamps.

15. An image forming device that records an image by using the flash fixing device comprising:

first and second flash lamps that emit light flashes that fix a toner image transferred onto a recording medium; and a light emission control unit that controls the light emission of the first and second flash lamps so that the light flashes emitted from the first flash lamp and the light flashes emitted from the second flash lamp are each irradiated at different timing on respective portions of the recording medium onto which the toner image is transferred, wherein the light emission control unit controls the light emission of the first and second flash lamps so that the first and second flash lamps each emit light at constant cycles, and so that a difference in irradiation timing of the light flashes from the first and second flash lamps to the same portion on the recording medium is less than half the light emission cycle of the first and second flash lamps.

16. A flash lamp light emission control method comprising:

emitting lights from a group of multiple flash lamps at one timing from at least two different preset timings; and emitting lights from another group of multiple flash lamps at another timing from the at least two different preset timings in order to fix a toner image transferred onto a recording medium, wherein the light emission control unit controls the light emission of the first and second flash lamps so that the first and second flash lamps each emit light at constant cycles, and so that a difference in irradiation timing of the light flashes from the first and second flash lamps to the same portion on the recording medium is less than half the light emission cycle of the first and second flash lamps.

17. The flash lamp light emission control method of claim 16, wherein at least one of the flash lamps further emits light during one light emission cycle, the one light emission cycle being a period from one light emission to a next light emission according to the different preset timings.

18. The flash lamp light emission control method of claim 16, wherein the at least two different preset timings include a first timing of emitting light on a central portion of the recording medium and a second timing of subsequently emitting light from the central portion towards the peripheral portions on the recording medium.

19. The flash lamp light emission control method of claim 16, wherein light emission in one light emission cycle for each of the multiple flash lamps is performed within less than one half the period of the one light emission cycle.

* * * * *